US011377759B2

(12) United States Patent
Sugawara

(10) Patent No.: US 11,377,759 B2
(45) Date of Patent: Jul. 5, 2022

(54) ELECTROSPINNING APPARATUS AND SYSTEM AND METHOD THEREOF

(71) Applicant: Kao Corporation, Tokyo (JP)

(72) Inventor: Hirokatsu Sugawara, Cincinnati, OH (US)

(73) Assignee: Kao Corporation, Tokyo (JP)

( * ) Notice: Subject to any disclaimer, the term of this patent is extended or adjusted under 35 U.S.C. 154(b) by 754 days.

(21) Appl. No.: 16/195,229

(22) Filed: Nov. 19, 2018

(65) Prior Publication Data

US 2019/0153624 A1 May 23, 2019

Related U.S. Application Data

(60) Provisional application No. 62/589,152, filed on Nov. 21, 2017.

(51) Int. Cl.
*D01D 5/00* (2006.01)
*D01D 13/00* (2006.01)

(52) U.S. Cl.
CPC ..... *D01D 5/0069* (2013.01); *D01D 5/003* (2013.01); *D01D 13/00* (2013.01)

(58) Field of Classification Search
CPC ..... D01D 5/0069; D01D 13/00; D01D 5/003; D01D 5/0061; B05B 5/03
See application file for complete search history.

(56) References Cited

U.S. PATENT DOCUMENTS 3,317,138 A 5/1967 Fraser
5,765,761 A * 6/1998 Law ..... B05B 5/03 239/690.1
2001/0038047 A1 11/2001 Wilson et al.
2012/0077014 A1 3/2012 Andrady et al.
2013/0011508 A1 1/2013 Kim
2014/0110493 A1 4/2014 Cooper
2015/0056263 A1* 2/2015 Norchi ..... A61L 26/0028 424/423

(Continued)

FOREIGN PATENT DOCUMENTS

CN 102597341 A 7/2012
CN 102803584 A 11/2012

(Continued)

OTHER PUBLICATIONS

The International Search Report and Written Opinion of the International Searching Authority dated Jan. 28, 2019 in PCT/US 18/61832 filed Nov. 19, 2018, 13 pages.

*Primary Examiner* — Michael M. Robinson
(74) *Attorney, Agent, or Firm* — Oblon, McClelland, Maier & Neustadt, L.L.P.

(57) ABSTRACT

Systems, apparatuses, and methods for reducing humidity of air adjacent to a nozzle of an electrospinning apparatus, charged solution output by the nozzle, a solution path between the nozzle and a deposit surface, and/or the deposit surface. The apparatus can be configured to controllably output the charged solution and gas of a predetermined dryness for deposit of the charged solution on the deposit surface. The gas of the predetermined dryness can be provided adjacent to a nozzle tip of the nozzle from where the charged solution is output. The gas of the predetermined dryness may be output in a predetermined direction toward a focal point at, in front of, or behind the nozzle tip.

18 Claims, 8 Drawing Sheets

(56) References Cited

U.S. PATENT DOCUMENTS

| | | | | |
|---|---|---|---|---|
| 2015/0275399 | A1 | 10/2015 | Kodama | |
| 2017/0145594 | A1 | 5/2017 | Uchida et al. | |
| 2019/0292685 | A1* | 9/2019 | Fong | D04H 1/728 |

FOREIGN PATENT DOCUMENTS

| | | | |
|---|---|---|---|
| CN | 103014885 | A | 4/2013 |
| CN | 103484952 | A | 1/2014 |
| CN | 104781460 | A | 7/2015 |
| KR | 10-2015-0018273 | A | 2/2015 |

* cited by examiner

ELECTROSPINNING APPARATUS AND SYSTEM AND METHOD THEREOF

CROSS REFERENCE TO RELATED APPLICATION

This application claims the benefit and priority of U.S. Provisional Patent Application No. 62/589,152, filed Nov. 21, 2017, the entire content and disclosure of which is incorporated by reference into the present application.

FIELD

Embodiments of the disclosed subject matter are directed generally to electrospinning apparatuses and systems and methods thereof. More particularly, embodiments of the disclosed subject matter are directed to portable, hand-held electrospinning apparatuses and systems, methods, and portions thereof.

SUMMARY

According to one or more embodiments of the present disclosure, an apparatus configured to controllably output a charged solution and gas of a predetermined dryness can be provided. The apparatus can comprise: a nozzle configured to output the charged solution from a nozzle opening at a nozzle tip of the nozzle; and a gas output port arranged relative to the nozzle configured to output the gas of the predetermined dryness at a predetermined reference rate at a discharge opening of the gas output port, and in a predetermined direction, such that the gas of the predetermined dryness is provided adjacent to the nozzle opening. The gas output port can be configured to output the gas of the predetermined dryness in the predetermined direction toward a focal point at, in front of, or behind the nozzle opening.

Also, in one or more embodiments, a system configured to controllably output a charged solution and gas of a predetermined dryness can be provided. The system can comprise: means for outputting the charged solution; and means for outputting the gas of the predetermined dryness at a predetermined reference rate at a discharge opening of the means for outputting the gas of the predetermined dryness, and in a predetermined direction, such that the gas of the predetermined dryness is provided adjacent to an output of the means for outputting the charged solution.

Embodiments can also include a portable, hand-held electrospinning apparatus configured to provide an electrospun solution and gas of a predetermined dryness toward a deposit surface. The electrospinning apparatus can comprise: a body; a nozzle provided at an extremity of the body configured to output the electrospun solution from a nozzle opening thereof toward the deposit surface; a control switch provided on the body; circuitry provided inside the body, the circuitry being operatively coupled to the control switch and controllable by manual input from a user to the control switch to controllably output the electrospun solution from the nozzle by controlling a pump operative to cause solution to be provided to the nozzle to be output as the electrospun solution; a power supply controllably coupled to the circuitry; a gas supply configured to provide the gas of the predetermined dryness; and a gas output port configured to output the gas of the predetermined dryness provided by the gas supply such that the gas of the predetermined dryness is provided adjacent to the nozzle opening. The gas output port can be recessed relative to the nozzle opening of the nozzle, and the circuitry can be configured to output the gas of the predetermined dryness prior to output of the electrospun solution.

Embodiments can also include methods of providing, making, and/or using apparatuses and systems according to one or more embodiments of the disclosed subject matter. Using apparatuses and/or systems according to one or more embodiments can reduce humidity of air surrounding the nozzle, the output solution, and/or a solution path between the nozzle and the deposit surface.

BRIEF DESCRIPTION OF THE DRAWINGS

The accompanying drawings, which are incorporated in and constitute a part of the specification, are illustrative of one or more embodiments of the disclosed subject matter, and, together with the description, explain various embodiments of the disclosed subject matter. Further, the accompanying drawings have not necessarily been drawn to scale, and any values or dimensions in the accompanying drawings are for illustration purposes only and may or may not represent actual or preferred values or dimensions. Where applicable, some or all select features may not be illustrated to assist in the description and understanding of underlying features.

DETAILED DESCRIPTION

Figure 1:
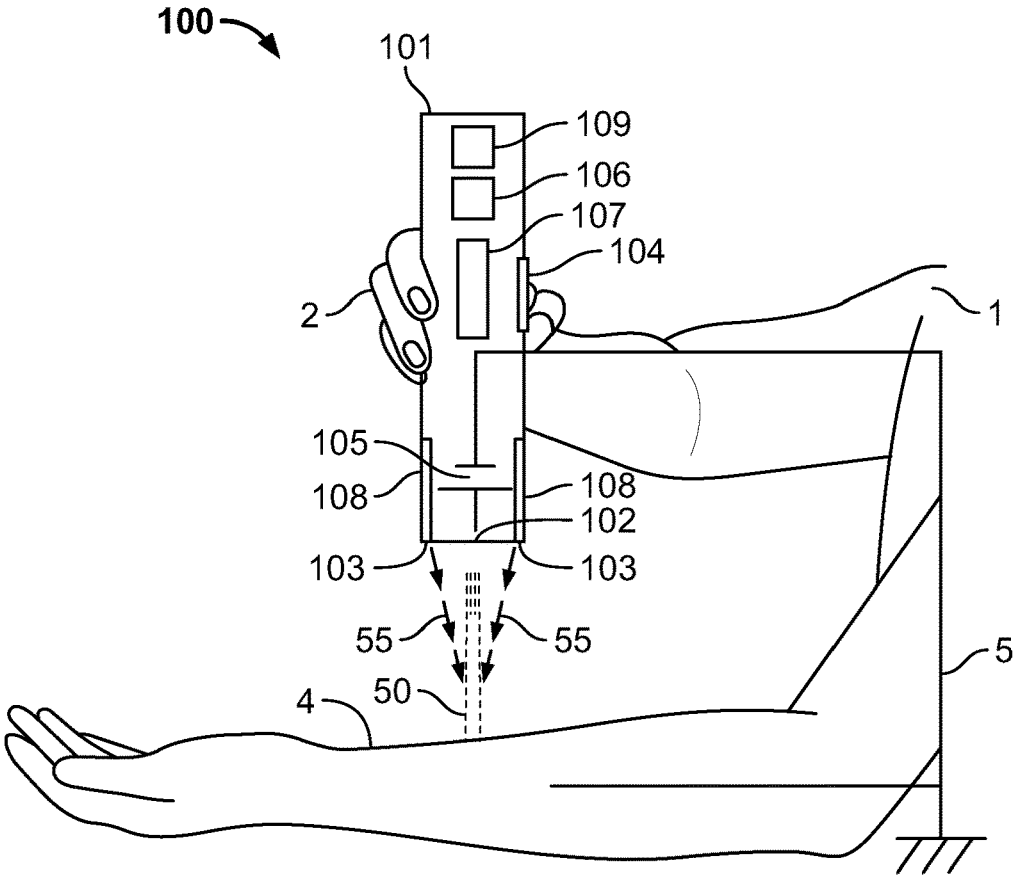
FIG. 1 is a diagram of an apparatus or a system according to one or more embodiments of the disclosed subject matter.

The description set forth below in connection with the appended drawings is intended as a description of various embodiments of the described subject matter and is not necessarily intended to represent the only embodiment(s). In certain instances, the description includes specific details for the purpose of providing an understanding of the described subject matter. However, it will be apparent to those skilled in the art that embodiments may be practiced without these specific details. In some instances, structures and components may be shown in block diagram form in order to avoid obscuring the concepts of the described subject matter.

Wherever possible, the same reference numbers will be used throughout the drawings to refer to the same or the like parts.

Any reference in the specification to "one embodiment" or "an embodiment" means that a particular feature, structure, characteristic, operation, or function described in connection with an embodiment is included in at least one embodiment. Thus, any appearance of the phrases "in one embodiment" or "in an embodiment" in the specification is not necessarily referring to the same embodiment. Further, the particular features, structures, characteristics, operations, or functions may be combined in any suitable manner in one or more embodiments, and it is intended that embodiments of the described subject matter can and do cover modifications and variations of the described embodiments.

It must also be noted that, as used in the specification, appended claims and abstract, the singular forms "a," "an," and "the" include plural referents unless the context clearly dictates otherwise. That is, unless clearly specified otherwise, as used herein the words "a" and "an" and the like carry the meaning of "one or more." Additionally, it is to be understood that terms such as "left," "right," "top," "bottom," "front," "rear," "side," "height," "length," "width," "upper," "lower," "interior," "exterior," "inner," "outer," and the like that may be used herein, merely describe points of reference and do not necessarily limit embodiments of the described subject matter to any particular orientation or configuration. Furthermore, terms such as "first," "second," "third," etc. merely identify one of a number of portions, components, points of reference, operations and/or functions as described herein, and likewise do not necessarily limit embodiments of the described subject matter to any particular configuration or orientation.

Embodiments of the disclosed subject matter are directed generally to electrospinning apparatuses and systems and methods thereof. More particularly, embodiments of the disclosed subject matter are directed to portable, hand-held electrospinning apparatuses and systems, methods, and portions thereof. In that embodiments of the disclosed subject matter can involve portable, hand-held electrospinning apparatuses and systems, methods, and portions thereof, such embodiments may be used in a clinical, salon, or at-home setting.

Such electrospinning apparatuses and systems, methods, according to one or more embodiments of the disclosed subject matter can reduce humidity of air adjacent to a nozzle of an electrospinning apparatus, charged solution output by the nozzle, a solution path between the nozzle and a deposit surface, and/or the deposit surface. Optionally, once the humidity is reduced, in one or more embodiments of the disclosed subject matter the humidity can be maintained or substantially maintained (e.g., within a predetermined range) at about the reduced humidity level.

Thus, in one or more embodiments, an apparatus (or system) can be configured to controllably output the charged solution and gas of a predetermined dryness for deposit of the charged solution on the deposit surface (e.g., human skin). Optionally, the gas of the predetermined dryness can be provided adjacent to a nozzle tip of the nozzle from where the charged solution is output. For example, the gas of the predetermined dryness may be output in a predetermined direction toward a focal point at, in front of, or behind the nozzle tip. Optionally, the output of the gas of the predetermined dryness may be at a predetermined rate, for instance, such that the gas does not propel the flow of the output charged solution and/or modify the shape of the flow of the output charged solution.

Generally speaking, electrospinning, which may be referred to as electric-field spinning, involves generating an electric field (EF) in and around a solution, for instance, a polymer solution, to draw out the solution to create relatively a fine fiber. A sufficiently high voltage must be provided to generate an electric field sufficient to produce a Taylor cone. A plurality of such fibers may form a mesh or web on a deposit surface, such as human skin, for instance.

The fiber diameter may be as small as a nanometer, for instance. That is, when the deposit of fibers is formed with the electrostatic spinning method, the thickness of the fibers expressed as a diameter of a corresponding circle can be preferably 10 nm or more, and more preferably 50 nm or more. In addition, the thickness can be preferably 3,000 nm or less, and more preferably 1,000 nm or less. The thickness of the fibers can be measured by observing the fibers magnified 10,000 times using a scanning electron microscopy (SEM), for example, removing defects (mass of fibers, intersection of fibers, and droplets) from the two-dimensional images of the fibers, selecting any ten fibers, drawing a line orthogonal to the longitudinal direction of each of the fibers, and reading the diameter of the fiber directly.

Preferable, in one or more embodiments, the fiber is continuous fiber. The fiber can be a continuous fiber having an infinite length in the formation; it is preferable that the fiber has a length at least 100 times longer than its thickness. In this specification, a fiber having a length over 100 times than its thickness is defined as a "continuous fiber." It is preferable that a coating formed with the electrostatic spinning method is a porous discontinuous coating including the deposit of continuous fibers.

The solution can have a viscosity of preferably about 1 mPa·s to about 1,200 mPa·s, more preferably about 50 mPa·s to about 500 mPa·s, even more preferably about 100 mPa·s to about 300 mPa·s. The viscosity can be measured according to one or more viscometer methodologies or types, such as a spindle-type (B-type) viscometer or a cone-plate-type (E-type) viscometer. For example, the spindle-type viscosity measurement can be performed using a type B viscometer (e.g., TVB-10 by TOKI SANGYO Co. LTD.) under the following characteristics/conditions: spindle No. M2 (21); rotational speed 60 rpm; and temperature 25° C. Additionally or alternatively, the cone-plate-type viscosity measurement can be performed using a type E viscometer (e.g., VISCON EMD by TOKYO KEIKI INC.) under the following characteristics/conditions: cone-plate rotor no. 43; rotational speed selected according to the specification of the viscometer according to the viscosity level: speed of 1 rpm:more than 1280 mPa·s, 10 rpm:more than 128 and less than 1280 mPa·s, and 100 rpm:less than 128 mPa·s; and temperature 25° C.

As noted above, the solution may be a polymer solution, in one or more embodiments of the disclosed subject matter. For example, the polymer solution may preferably be a water insoluble polymer having a coating formation ability, for instance, including completely saponified polyvinyl alcohol, which can be insolubilized after the formation of a coating; partially saponified polyvinyl alcohol, which can be cross-linked after the formation of a coating when used in combination with a cross-linking agent; oxazoline modified silicone such as a poly(N-propanoylethyleneimine)-grafted dimethylsiloxane/γ-aminopropylmethylsiloxane copolymer; polyvinylacetal diethylamino acetate; zein (main component of corn proteins); polyester; polylactic acid (PLA); an acrylic resin such as a polyacrylonitrile resin or a polymethacrylic acid resin; a polystyrene resin; a polyvinyl butyral resin; a polyethylene terephthalate resin; a polybutylene terephthalate resin; a polyurethane resin; a polyamide resin; a polyimide resin; and a polyamideimide resin. More preferably the polymer solution can be or comprise polyvinyl butyral resin. The term "water-insoluble polymer" as used herein can refer to a polymer having a property such that when 1 g of the polymer is weighed out and immersed in 10 g of ion-exchanged water in an environment at a pressure of 1 atmosphere and a temperature of 23° C. for 24 hours, more than 0.5 g of the immersed polymer does not dissolve in the water. Optionally, the polymer solution can preferably lack suspended solids (e.g., powder). That is, the polymer solution may be free or substantially free of suspended solids (e.g., powder).

Additionally or alternatively, in one or more embodiments of the disclosed subject matter, the solution may be a liquid agent comprising component (a), component (b), and component (c) as follows: component (a) may be one or more volatile substances selected from the group consisting of alcohols and ketones; component (b) may be water; and component (c) may be one or more polymers having a coating formation ability.

Preferable examples of alcohols that may serve as the volatile substance to be used as the component (a) include chain aliphatic monohydric alcohols, cyclic aliphatic monohydric alcohols, and aromatic monohydric alcohols. Specific examples thereof include ethanol, isopropyl alcohol, butyl alcohol, phenylethyl alcohol, propanol, and pentanol. One or more alcohols selected from these alcohols can be used. Examples of ketones serving as the volatile substance to be used as the component (a) can include acetone, methyl ethyl ketone, and methyl isobutyl ketone. These ketones can be used alone or in combination of two or more. The volatile substance to be used as the component (a) can be more preferably at least one member selected from ethanol, isopropyl alcohol, and butyl alcohol, even more preferably at least one member selected from ethanol and butyl alcohol, and even more preferably ethanol.

Generally speaking, component (a) can be volatile and disperse or dissolve component (c). The term "disperse or dissolve" as used herein can refer to a state in which a substance is in a dispersed state at 20° C. and the dispersion is uniform when visually observed, and preferably transparent or translucent when visually observed.

Component (c) can be preferably hydrophobicity (water-insoluble). For example, in the case of the polymer having a coating formation ability, a polymer can be used that is appropriate according to the properties of the volatile substance to be used as the component (a). Specifically, polymers having a coating formation ability may be roughly classified into water-soluble polymers and water-insoluble polymers. The term "water-soluble polymer" as used herein can refer to a polymer having a property such that when 1 g of the polymer is weighed out and immersed in 10 g of ion-exchanged water in an environment at a pressure of 1 atmosphere and a temperature of 23° C. for 24 hours, 0.5 g or more of the immersed polymer dissolves in the water. On the other hand, as noted above, the term "water-insoluble polymer" as used herein can refer to a polymer having a property such that when 1 g of the polymer is weighed out and immersed in 10 g of ion-exchanged water in an environment at a pressure of 1 atmosphere and a temperature of 23° C. for 24 hours, more than 0.5 g of the immersed polymer does not dissolve in the water.

Examples of water-soluble polymers having a coating formation ability include naturally-occurring macromolecules such as pullulan, hyaluronic acid, chondroitin sulfate, poly-γ-glutamic acid, modified corn starch, β-glucan, glucooligosaccharide, mucopolysaccharide such as heparin and keratosulfate, cellulose, pectin, xylan, lignin, glucomannan, galacturonic acid, *psyllium* seed gum, tamarind seed gum, gum arabic, gum traganth, water-soluble soybean polysaccharide, alginic acid, carrageenan, laminaran, agar (agarose), fucoidan, methyl cellulose, hydroxypropyl cellulose, hydroxypropyl methyl cellulose; and synthetic macromolecules such as partially saponified polyvinyl alcohol (when not used in combination with a cross-linking agent), low saponified polyvinyl alcohol, polyvinyl pyrrolidone (PVP), polyethylene oxide, and sodium polyacrylate. These water-soluble polymers can be used alone or in combination of two or more. It is preferable to use pullulan and the synthetic macromolecules such as partially saponified polyvinyl alcohol, low saponified polyvinyl alcohol, polyvinyl pyrrolidone, and polyethylene oxide, of these water-soluble polymers, from the viewpoint of easily manufacturing the coating. When polyethylene oxide is used as the water-soluble polymer, its number average molecular weight can be preferably 50,000 or more and 3,000,000 or less, and more preferably 100,000 or more and 2,500,000 or less.

On the other hand, examples of the water-insoluble polymers having a coating formation ability can include completely saponified polyvinyl alcohol, which can be insolubilized after the formation of a coating; partially saponified polyvinyl alcohol, which can be cross-linked after the formation of a coating when used in combination with a cross-linking agent; oxazoline modified silicone such as a poly(N-propanoylethyleneimine)-grafted dimethylsiloxane/γ-aminopropylmethylsiloxane copolymer; polyvinylacetal diethylamino acetate; zein (main component of corn proteins); polyester; polylactic acid (PLA); an acrylic resin such as a polyacrylonitrile resin or a polymethacrylic acid resin; a polystyrene resin; a polyvinyl butyral resin; a polyethylene terephthalate resin; a polybutylene terephthalate resin; a polyurethane resin; a polyamide resin; a polyimide resin; and a polyamideimide resin. These water-insoluble polymers can be used alone or in combination of two or more. It is preferable to use completely saponified polyvinyl alcohol, which can be insolubilized after the formation of a coating, partially saponified polyvinyl alcohol, which can be cross-linked after the formation of the coating when used in combination with a cross-linking agent, a polyvinyl butyral resin, oxazoline modified silicone such as a poly(N-propanoylethyleneimine)-grafted dimethylsiloxane/γ-aminopropylmethylsiloxane copolymer, water-soluble polyester, zein, and the like, of these water-insoluble polymers.

The content of the component (a) in the composition can be preferably 50 mass % or more, more preferably 55 mass % or more, and even more preferably 60 mass % or more. In addition, the content of the component (a) in the composition can be preferably 98 mass % or less, more preferably 96 mass % or less, and even more preferably 94 mass % or less. The content of the component (a) in the composition can be preferably 50 mass % or more and 98 mass % or less, more preferably 55 mass % or more and 96 mass % or less, and even more preferably 60 mass % or more and 94 mass % or less.

On the other hand, the content of the component (c) in the composition can be preferably 2 mass % or more, more preferably 4 mass % or more, and even more preferably 6 mass % or more. In addition, the content of the component (c) in the composition can be preferably 50 mass % or less, more preferably 45 mass % or less, and even more preferably 40 mass % or less. The content of the component (c) in the composition can be preferably 2 mass % or more and 50 mass % or less, more preferably 4 mass % or more and 45 mass % or less, and even more preferably 6 mass % or more and 40 mass % or less. When the component (c) is blended into the composition in this proportion, a desired coating can be successfully formed.

The component (b) can be preferably contained from the viewpoint of conductivity of the liquid agent, and the content can be preferably 10% or less, more preferably 5% or less with respect to the component (a), from the viewpoint of spinnability, preferably the content can be 0.5% or more.

One or more embodiments of the disclosed subject matter can involve application of a cosmetic, such as a base/foundation, a concealer, a moisturizer, and coloring. Of course, embodiments of the disclosed subject matter are not limited to application of cosmetics. For example, one or more embodiments of the disclosed subject matter can involve application of deodorants, scents, sun protection, creams, topical drug delivery, anti-microbial barriers and coatings, hydrophobic/phallic surface treatments, anti-fouling coatings, tissue repair, etc.

Turning now to the figures, FIG. 1 shows a diagram of an apparatus or a system (hereinafter apparatus) 100 according to one or more embodiments of the disclosed subject matter. As can be seen, apparatus 100 can be a hand-held apparatus, for instance, usable by only one hand 2 of a user 1. The apparatus 100 may also be portable, meaning, generally speaking, that the apparatus 100 is not fixed or substantially fixed in one place, but instead may be relatively easily movable from location to location (e.g., different rooms, stores, etc.). Optionally, the apparatus 100 may be wireless, power and control being provided by the apparatus 100 itself. Alternatively, power may be supplied from a power supply remote from the apparatus 100, such as mains via a flexible power cord that is pluggable into a wall outlet (not expressly shown).

As noted above, the apparatus 100 may be an electrospinning apparatus, and can output charged solution in electrospun format 50. Generally, for electrospinning, a deposit surface 4 on which the fibers are to be deposited on should or must be at or near ground potential. As such, the deposit surface 4, such as skin of the user 1, should be grounded during the electrospinning process. In terms of grounding the user 1, this may be accomplished by grounding the user 1 to the apparatus 100, a base station (not expressly shown), or some other grounded structure. For example, a ground path 5 may be provided, as illustrated in FIG. 1, via a grounding line connected to the apparatus 100, via a rod or a plate on a grip of the apparatus and optionally a grounding strap attached to the user 1. Alternatively, a ground path may be provided via a grounding strap attached to the user and a grounding line connected to the base station (not shown), or via a grounding route separate from the apparatus 100, such as a grounding route integrated into a chair, seat, table, metal plate, or other structure. Also, in the case of someone other than the user 1, for instance, an esthetician, using the apparatus 100 to apply the electrospun solution 50 to the user 1, the other person may also be grounded, for example, via the apparatus 100 or a separate grounding route, such as described above.

The flow rate of the output charged solution 50 may be about 0.17 ml/min, preferably about 0.07 ml/min, more preferably about 0.01 to about 0.50 ml/min, even more preferably about 0.03 to about 0.40 ml/min, and even more preferably about 0.05 to about 0.3 ml/min. Further, the flow rate may be caused or set based on current and voltage supplied to create the electric field, and desired fiber properties to be output. The flow rate may also be dependent upon characteristics of the solution, such as molecular weight, type, conductivity; environmental aspects, such as ambient temperature and/or ambient humidity; and apparatus configuration, such as the configuration of a nozzle 102 thereof.

The apparatus 100 can be comprised of a body 101; a nozzle 102 configured to output charged solution 50, which may be provided at an extremity of the body 101 as part of the body 101 or as a component separate from the body 101, and which may have a nozzle tip and a nozzle opening (not expressly shown in FIG. 1) for which to output the charged solution 50; and a gas output port 103, arranged relative to the nozzle 102, configured to output gas of a predetermined dryness 55.

The apparatus 100 can also include a user interface 104, which may be manually operated by the user 1, and which may have one or more control interfaces (e.g., control switches, buttons, etc.) to controllably output the charged solution 50 and the gas of the predetermined dryness 55. Optionally, different control interfaces may be used to control the output of the charged solution 50 and the output of the gas of the predetermined dryness 55. Alternatively, a single control interface may control output of both the charged solution 50 and the gas of the predetermined dryness 55.

The apparatus 100 may also be comprised of circuitry 106, which may include at least one controller, provided inside the body 101, for instance; a pump configured to cause solution from a solution reservoir 107 to be provided to the nozzle 102 to be charged via a high voltage electrode 105, and output from the nozzle 102 as the charged solution in electrospun format 50. The circuitry 106 may be operatively coupled to the user interface 104 and controllable by manual input from the user 1 to the user interface 104 to controllably output the charged solution 50 from the nozzle 102 by controlling the pump to cause solution to be provided to the nozzle 102 and charged by high voltage electrode 105 and output as the charged solution in electrospun format 50. The high voltage for the high voltage electrode 105 may be provided by a power supply 109, which may be provided inside the body 101 of the apparatus 100. The power supply 109 may also supply non-high voltage power to the circuitry 106, for instance, to provide power the pump, the user interface, any electrical components that may be implemented to control output of the gas of the predetermined dryness 55, a humidity sensor of the apparatus 100, etc.

The apparatus 100 may also be comprised of a gas supply 108 to provide gas of the predetermined dryness to the gas output port 103 for output as the gas of the predetermined dryness 55. The gas supply 108 may be in the form of one or more gas supply lines, whereby the gas is provided to the gas supply line(s) via a gas reservoir provided separate from the apparatus 100. Alternatively, the gas supply 108 may be provided onboard the apparatus 100. That is, the apparatus 100 may be comprised of the gas reservoir, for instance, inside the body 101 or outside the body 101.

Thus, the apparatus 100 can be controlled, via the user interface 104 and controller of the circuitry 106, to output one or more streams of the gas of the predetermined dryness 55. Thus, in one or more embodiments, the apparatus 100 can controllably output the charged solution 50 and the gas of a predetermined dryness 55 for deposit of the charged solution 50 on the deposit surface (e.g., human skin) 4.

The gas of the predetermined dryness 55 can include one or more of air, compressed air, $O_2$, $N_2$, Ar, He, and $CO_2$. Further, the gas of the predetermined dryness 55 can output at a predetermined reference rate at a discharge opening (or openings) of the gas output port 103. According to one or more embodiments of the disclosed subject matter, such predetermined rate can be preferably in a range of about 0.05 m/s to about 10 m/s, more preferably in a range of about 0.15 m/s to about 1 m/s. Optionally, the predetermined rate may be such that the gas of the predetermined dryness 55 does not propel the flow of the output charged solution 50 and/or modify the shape of the flow of the output charged solution 50. Optionally, the predetermined rate of the gas of the predetermined dryness 55 can be based on a cross-sectional area of a nozzle opening of the nozzle 102 and/or a cross-sectional area of the discharge opening of the gas output port 103. Further, the gas of the predetermined dryness 55 may be output from the apparatus 100 continuously or pulsed.

The output of the gas of the predetermined dryness 55 can reduce humidity of air adjacent to the nozzle 102 of the apparatus 100 (e.g., in front of a nozzle tip of the nozzle 102), the charged solution 50 output by the nozzle 102, a solution path or intended path between the nozzle 102 and the deposit surface 4, and/or the deposit surface 4. Optionally, once the humidity is reduced, in one or more embodiments of the disclosed subject matter, the humidity can be maintained or substantially maintained (e.g., within a predetermined range) at about the reduced humidity level by continuous or periodic supply of the gas of the predetermined dryness 55. In one or more embodiments, the apparatus 100 may be configured to operate when surrounding environmental conditions are over about 50% RH at about 25° C. For example, the apparatus 100 may be configured such that the gas of the predetermined dryness 55 can be output only when the surrounding environmental conditions are over about 50% RH at about 25° C., for instance, as sensed by an optional humidity sensor of the apparatus 100. Optionally, the apparatus 100 may be configured such that the charged solution 50 can be output only when the surrounding environmental conditions are over about 50% RH at about 25° C., for instance, as sensed by the humidity sensor of the apparatus 100.

The gas of the predetermined dryness 55 can have a predetermined RH, which may correspond to a humidity less than a humidity of an associated room in which the apparatus 100 is operated. For example, the gas of the predetermined dryness 55 can have a humidity between about 10% RH and about 30% RH. Further, in one or more embodiments, output of the gas of the predetermined dryness 55 can reduce the humidity preferably to below 50% RH, more preferably to between about 10% RH and about 30% RH.

The gas of the predetermined dryness 55 may be output toward the deposit surface 4 and/or toward the charged solution 50 output from the apparatus 100. The configuration of a gas output port or ports (not expressly shown in FIG. 1) of the apparatus 100 can, in one or more embodiments, dictate a direction or directions for output of the charged solution 50.

In one or more embodiments, the gas of the predetermined dryness 55 may be output in a predetermined direction such that the gas of the predetermined dryness 55 is provided adjacent to an opening (or openings) of the nozzle 102. Optionally, adjacent to the opening (or opening) can mean in front of the nozzle opening and/or a tip of the nozzle 102 in an axial direction of the nozzle 102. For example, in front of the nozzle opening may include any position or positions preferably from about 0 mm to about 200 mm, more preferably from about 0 mm to about 100 mm, even more preferably from about 0 mm to about 50 mm, from the tip of the nozzle 102 in an axial direction of the nozzle 102. Additionally or alternatively, adjacent to the nozzle opening or nozzle tip can include any position or positions from at the deposit surface 4 to the nozzle tip. For example, the deposit surface 4 can be about 30 mm away from the nozzle tip.

In one or more embodiments, the gas of the predetermined dryness 55 may be output in a predetermined axial direction that corresponds to an axis of a corresponding discharge opening of the gas output port 103, in the same direction or generally the same direction as a direction in which the charged solution 50 is output from the nozzle 102. In one or more embodiments, the predetermined axial direction may be non-parallel to an axial direction in which the charged solution 50 is output from the nozzle 102. Optionally, the gas of the predetermined dryness 55 may be directed toward a predetermined focal point or points (not expressly shown in FIG. 1). In one or more embodiments, the predetermined focal point may be at, in front of, or behind the nozzle tip. The focal point may be from about 0 mm to about 200 mm, preferably from about 0 mm to about 100 mm, more preferably from about 0 mm to about 50 mm, and even more preferably about 30 mm, from the nozzle tip, in front of and in the axial direction of the nozzle 102. Optionally, the focal point may be aligned with a central axis of the nozzle opening. Thus, in one or more embodiments, the gas of the predetermined dryness 55 may be output so as to meet the charged solution 50 output from the nozzle 102 and/or a path of the charged solution 50 between the nozzle 102 and the deposit surface 4. For example, the gas of the predetermined dryness 55 may meet the charged solution 50 output from the nozzle 102 or the path of the charged solution 50 from about at the opening at the nozzle tip to about 200 mm away from the nozzle tip in an axial direction of the nozzle 102. Additionally or alternatively, the gas of the predetermined dryness 55 may meet the charged solution 50 at the deposit surface 4.

Optionally, in one or more embodiments, the gas of the predetermined dryness 55 can be output prior to output of the charged solution 50. The charged solution 50 may then be output while the gas of the predetermined dryness 55 is still being output, or, alternatively, the gas of the predetermined dryness 55 may stop being output before the charged solution 50 is output. Also, in one or more embodiments, the gas of the predetermined dryness 55 may stop being output while the charged solution 50 is still being output or vice versa. Thus, during an output cycle, the gas of the predetermined dryness 55 and the charged solution 50 may be output at the same time, though with different start and/or stop times. Or, alternatively, the output of the gas of the predetermined dryness 55 and the output of the charged solution 50 may not overlap. The controller of the circuitry 106 may control the timing of the outputs of the gas of the predetermined dryness 55 and the charged solution 50. Optionally, the timing may be changed by the user 1 via the user interface 104.

Figure 2:
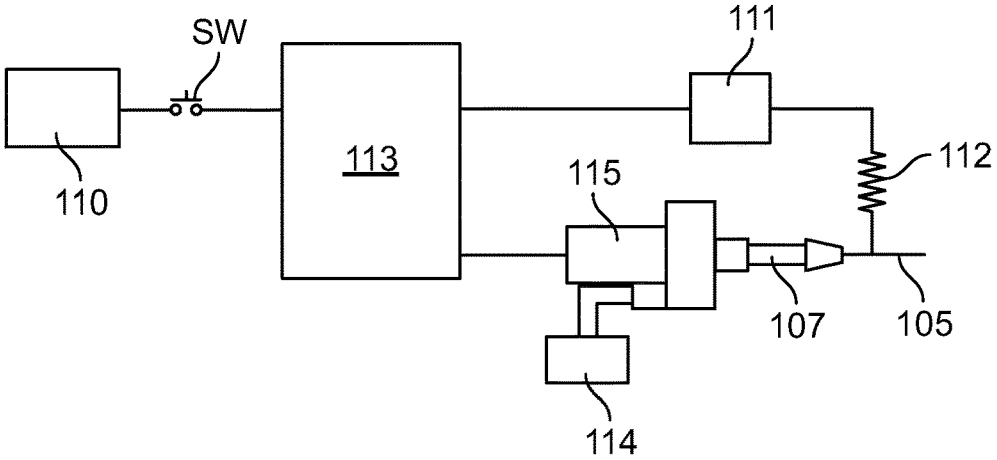
FIG. 2 is a block diagram of a portion of the apparatus or system of FIG. 1, according to one or more embodiments of the disclosed subject matter.

FIG. 2 is a block diagram of a portion of an apparatus according to one or more embodiments of the disclosed subject matter, such as the apparatus 100 of FIG. 1. Likewise, FIG. 3 is diagram of a portion of an apparatus, according to one or more embodiments of the disclosed subject matter, such as the apparatus 100 of FIG. 1.

Figure 3:
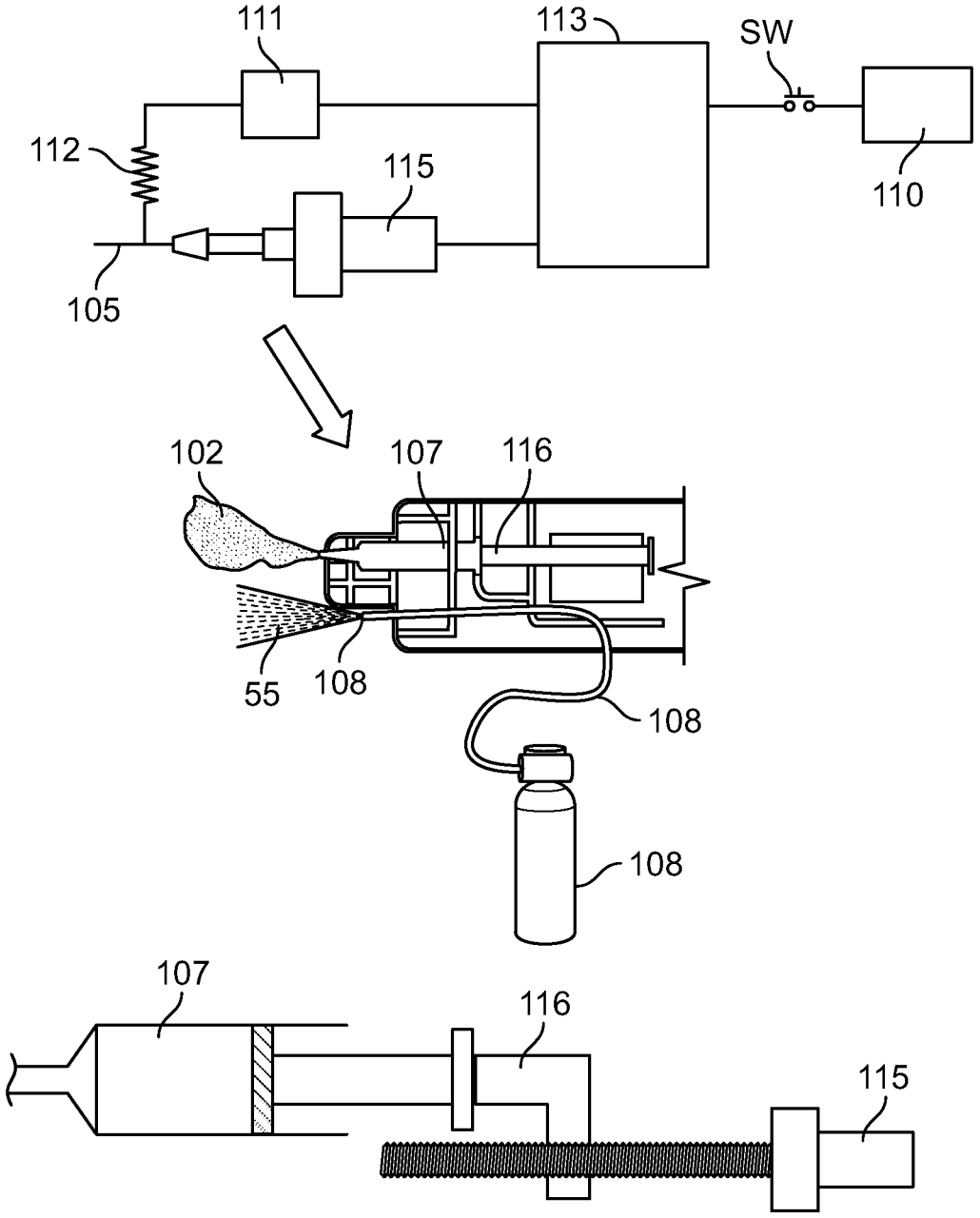
FIG. 3 is a diagram of an apparatus or a system according to one or more embodiments of the disclosed subject matter.

Generally speaking, FIG. 2 and FIG. 3 show examples of components, and an exemplary configuration, to output the charged solution 50. FIG. 3 also shows examples of components, and an exemplary configuration, to output the charged solution 50 and the gas of the predetermined dryness 55.

In particular, FIG. 2 shows a low voltage power supply 110, a high voltage power source 111, a high voltage resistor 112, a power switch SW, a controller 113, a controller 114, the high voltage electrode 105, the solution reservoir 107, and a motor 115. Optionally, one or more of the low voltage power supply 110, the high voltage power source 111, high voltage resistor 112, the power switch SW, and the controller 113 may be part of the power supply 109. Further, optionally, the power switch SW may be coupled to the user interface 104. The low voltage power supply 110 may be provided by mains or a battery (or batteries) and may be a power source that outputs a relatively low voltage, for instance, about 3 VDC to about 9 VDC. Such voltage may be provided to the controller 113 when the power switch SW is closed (e.g., when the user 1 activates the user interface 104 to output the charge solution 50, with or without the gas of the predetermined dryness 55). The controller 113, which may alternatively be represented by distinct controllers, can provide separate relatively low voltages to control the motor 115, which may be a servo motor, and for conversion by the high voltage power source 111 to a relatively high voltage to be provided to the high voltage electrode 105. Alternatively, the controller 113 and the controller 114 may be a single controller. Further, optionally, the single controller may also control output of the gas of the predetermined dryness 55. Alternatively, a separate controller may control output of the gas of the predetermined dryness 55. Further, in one or more embodiments, the controller that controls output of the gas of the predetermined dryness 55 may be merely a physical controller, for instance, a valve that opens and closes in response to operation of a control interface, for instance, of the user interface 104.

The high voltage electrode 105 may be hollow, and may be conductive. For example, the high voltage electrode 105 may be a so-called needle electrode. Thus, the high voltage electrode 105 may serve as both a fluid path for the solution and a conductive surface to allow charge created by an electric field caused by the high voltage HV to be injected into the solution. More specifically, the high voltage electrode 105, which may be part of the nozzle 102 in one or more embodiments of the disclosed subject matter, may be hollow so as to receive solution from the solution reservoir 107 and output the solution at or just before the nozzle tip of the nozzle 102. Generally, the flow path formed by the high voltage electrode 105 and the nozzle tip may be formed of materials that do not or do not substantially chemically or physio-chemically react with the solution in any substantial way.

The high voltage power source 111 may have or be coupled to a transformer that converts a relatively low voltage from the controller 113 (e.g., about zero to about 9 VDC), to the relatively high voltage, particularly a relatively high DC voltage. The high voltage should be sufficiently high to create an electric field that can generate a Taylor cone of the solution; also a current supply sufficient to charge up the solution and also overcome parasitic losses/capacitances should be supplied. Thus, in embodiments of the disclosed subject matter, the high voltage power source 111 can produce high voltage with sufficient current output to perform a desired electrospin operation. The high DC voltage may be preferably about 14 kV DC; more preferably about 11 kV DC to about 14 kV DC; and even more preferably about 10 kV DC to about 16 kV DC. Optionally, the high voltage may be controllable, for instance, preferably from about 11 kV DC to about 14 kV DC; more preferably about 10 kV DC to about 16 kV DC. The value of the high voltage resistor 112 can be based on the high voltage to be provided to the high voltage electrode 105. For example, the value of the high voltage resistor 112 may be about 200 MΩ, though embodiments of the disclosed subject matter are not so limited.

Thus, the user 1 can provide a control input to the user interface 104 to cause a high voltage HV from the high voltage power source 111 and thus a corresponding electric field to be applied in and around solution in the high voltage electrode 105, and to cause the motor 115 to output solution from the solution reservoir 107 to the high voltage electrode 105, such that the charged solution 50 is output in electrospun fashion from the nozzle 102. The controller 114 can control the motor 115 to output solution from the solution reservoir 107 to the high voltage electrode 105, for instance, based on the control input to the user interface 104.

The user interface 104 of the body 101 may be in the form of a trigger or a switch, for instance, a tactile switch or trigger. The user interface 104 can be activated by user input, for instance, a user's finger or thumb, to activate the apparatus 100. Specifically, the user interface 104 can be activated by the user 1 to activate the motor 115 to output the solution to the nozzle 102 and output therefrom, to activate the high voltage HV to create a corresponding electric field for application to the solution, or both. Generally, the user interface 104 may be provided far enough away from the nozzle 102 to prevent interference, for instance. As a non-limiting example, the user interface 104 may be about 44 mm from the nozzle 102.

The motor 115 may be a stepper motor or a servo motor as mentioned above, for instance, that drives the actuator 116, which may be a linear actuator. The motor 115 and actuator 116 can be controlled based on operation of the user interface 104. Generally speaking, actuation of the actuator 116 can drive a plunger relative to a solution reservoir 107 to cause the solution to be output from the reservoir 107 to the nozzle 102, for instance, via the high voltage electrode 105, for application of high voltage HV and output from the nozzle 102 as the charged solution 50. Optionally, the motor 115 may be programmable, for instance, using the circuitry 106. Such programming may provide for different flow profiles to be used based on particular application conditions, such as environment, type of solution to be applied, high voltage HV applied, etc. Optionally, the actuator 116 can be controlled, prior to an electrospinning operation, to prime the handset 100 by removing air from the solution flow path.

The motor 115 and actuator 116 may not provide back suction. That is, in one or more embodiments, back suction of the solution may not be provided. Alternatively, the motor 115 and actuator 116 may be controlled to provide back suction, for instance, for a predetermined duration of time. The predetermined duration of time may be preferably about 0.1 seconds; more preferably about 0.5 seconds, after stopping output of the charged solution 50 from the nozzle 102.

The circuitry 106, including one or more controllers thereof, such as controller 114, may, as discussed above, controllably output the charged solution 50 and/or the gas of the predetermined dryness 55 from the nozzle 102 and the gas output port 103, respectively. Further, in one or more embodiments, the circuitry 106 can control one more of changing a rate at which the charged solution 50 is output, changing an amount of the charged solution 50 output, a time period for which the charged solution 50 is output, and a timing at which the charged solution 50 is output, for instance, relative to the output of the gas of the predetermined dryness 55. Likewise, additionally or alternatively, the circuitry 106 can control one more of changing a rate at which the gas of the predetermined dryness 55 is output, changing an amount of the gas of the predetermined dryness 55 output, a time period for which the gas of the predetermined dryness 55 is output, and a timing at which the gas of the predetermined dryness 55 is output.

In one or more embodiments, the circuitry 106 can control, for an output cycle, the gas of the predetermined dryness 55 to be output from the gas output port 103 followed by, at a same time, the charged solution 50 to be output from the nozzle opening of the nozzle 102 and the gas of the predetermined dryness 55 to be output from the gas output port 103. For example, the gas of the predetermined dryness 55 can be output from the gas output port 103 for about 0.1 to about 1.0 seconds before the charged solution 50 is output from the nozzle opening. Additionally or alternatively, the circuitry 106 can control, for the output cycle, the gas of the predetermined dryness 55 to be stopped from being output from the gas output port 103 prior to stopping the charged solution 50 from being output from the nozzle opening. Optionally, during the output cycle, the gas of the predetermined dryness 55 can be controlled by the circuitry so as to be output from the gas output port 103 one of continuously or pulsed on and off. Further, the circuitry 106 can control, during an output cycle, the gas of the predetermined dryness 55 to be output from the gas output port 103 for a first predetermined amount of time and the charged solution 50 to be output from the nozzle opening for a second predetermined amount of time. The first predetermined amount of time may be different from the second predetermined amount of time. For example, the first predetermined amount of time may be less than or greater than the second predetermined amount of time. Alternatively, the first and second predetermined amounts of time may be the same.

Figure 4:
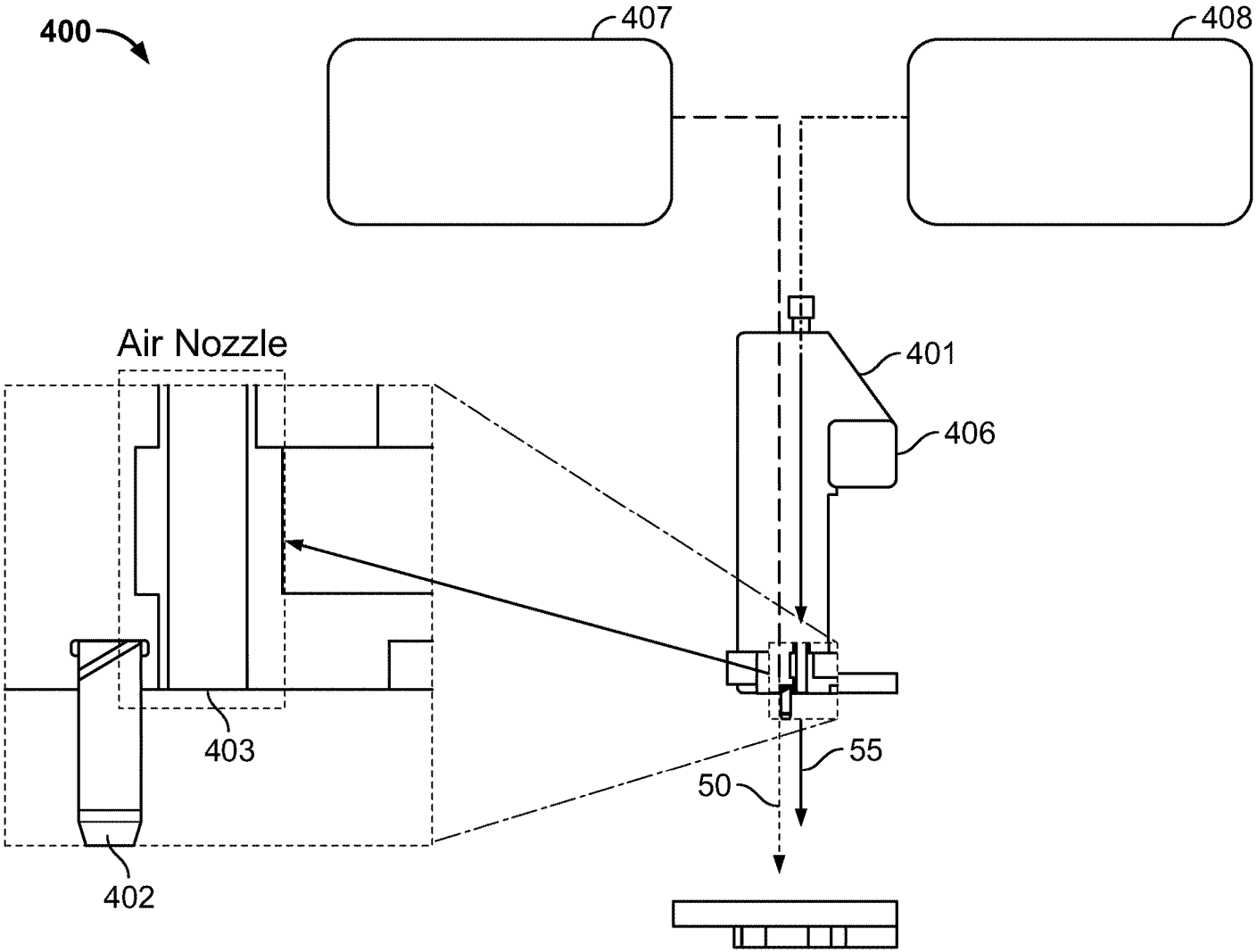
FIG. 4 is a diagram of an apparatus or a system according to one or more embodiments of the disclosed subject matter.

Turning now to FIG. 4, this shows a diagram of an apparatus or a system 400 (hereinafter apparatus) according to one or more embodiments of the disclosed subject matter. The apparatus 400 can be comprised of the components expressly illustrated in FIG. 4, particularly, a body 401, a nozzle 402, a gas output port 403, circuitry 406, gas supply 408, and solution reservoir or supply 407. Of course, the apparatus 400 can also include other components not expressly shown, such as some or all of the components discussed above for the apparatus 100. Further, the apparatus 400 can operate the same as or substantially the same as apparatus 100. Like apparatus 100 above, the apparatus 400 can controllably output the charged solution 50 and gas of a predetermined dryness 55 for deposit of the charged solution 50 on the deposit surface 4 (e.g., human skin), where the gas of the predetermined dryness 55 can be provided adjacent to a nozzle tip of the nozzle 402 from where the charged solution is output.

Notably for apparatus 400, the gas output port 403 can be recessed relative to a nozzle opening of the nozzle 402. For example, in one or more embodiments, the nozzle tip may project from the body 401 of the apparatus 400 more than does the gas output port 403. Further, the gas output port 403 may be offset in a side view relative to the nozzle 402, such as illustrated in FIG. 4. Additionally or alternatively, in a front view or end view of the apparatus 400, a central axis of the gas output port 403 can be offset from a central axis of the nozzle opening by a predetermined distance D1. FIG. 5B shows an exemplary distance D1, which may be about 5 mm to about 150 mm, more preferably about 7 mm to about 20 mm. Further, optionally, in the front view or end view of the apparatus 400, the gas output port 403 may not overlap the nozzle opening of the nozzle 402, such as illustrated in FIG. 5B.

Figure 6A:
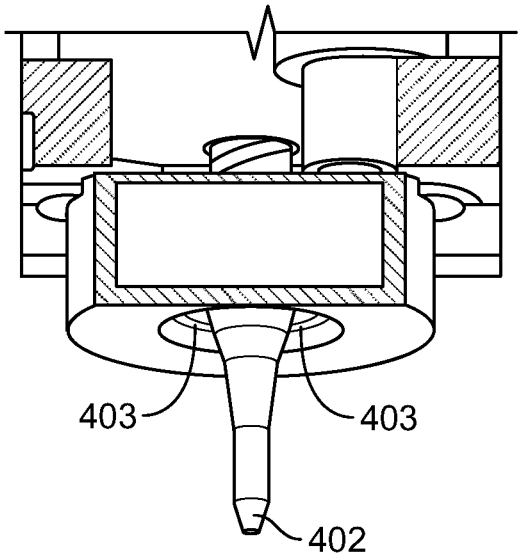
FIG. 6A is a perspective sectional view of a portion of an apparatus or a system according to one or more embodiments of the disclosed subject matter.
Figure 6B:
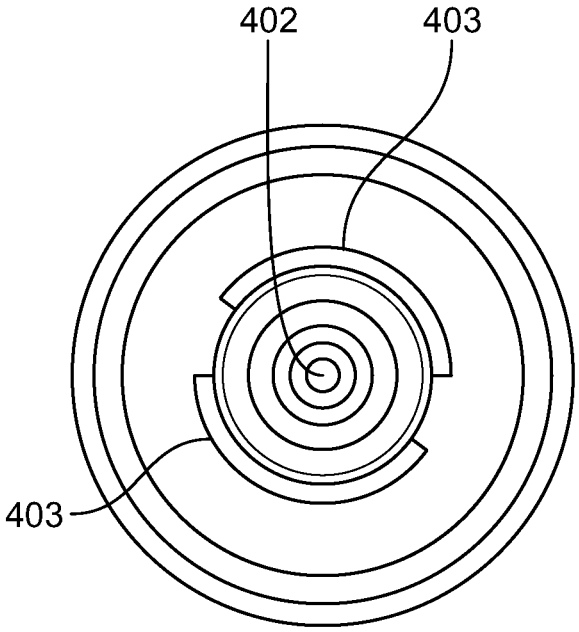
FIG. 6B is a bottom perspective view of the portion of FIG. 6A.

Alternatively, the gas output port 403 may overlap with the nozzle opening of the nozzle 402, for instance, concentrically aligned as illustrated in FIG. 6B. That is, in the front view of the apparatus 400, a central axis of the gas output port 403 can be aligned with a central axis of the nozzle opening of the nozzle 402.

Figure 5A:
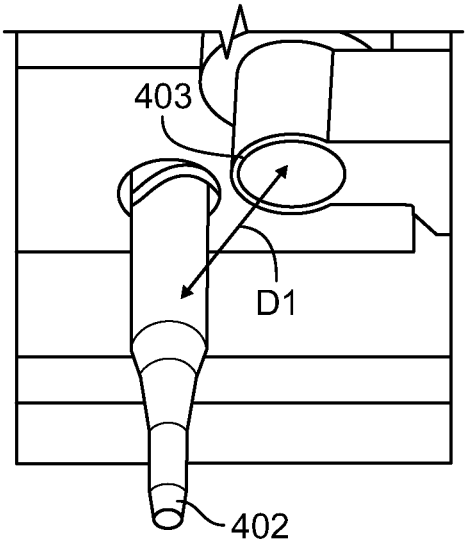
FIG. 5A is a bottom perspective view of a portion of the apparatus or a system of FIG. 4.
Figure 5B:
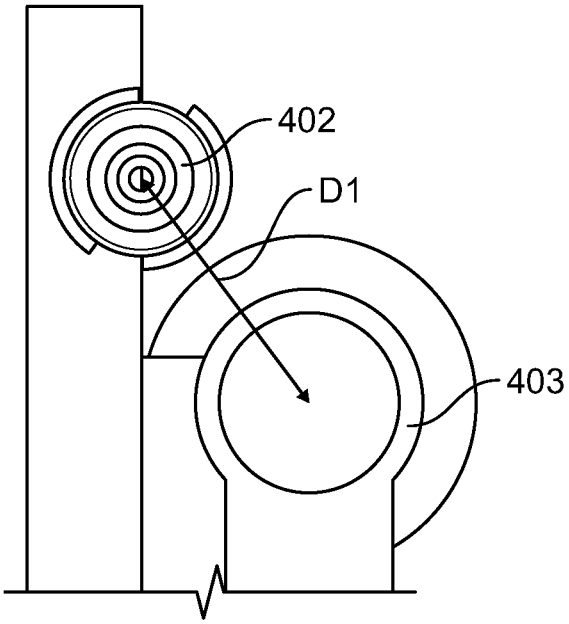
FIG. 5B is a bottom plan view of a portion of the apparatus or a system of FIG. 4.

As illustrated in FIGS. 4, 5A, and 5B, the apparatus 400 may have a gas output port 403 in the form of a single opening. That is, the gas output port 403 may consist of a single opening configured to output the gas of the predetermined dryness 55. For example, the single opening may define a circular or oval opening. Alternatively, the single opening may define a continuous slit, either straight or curved. Optionally, the single opening may be a continuous slit that runs entirely or partially around the nozzle 402 in the front view of the apparatus 400. That is, the continuous slit may partially or fully surround the nozzle opening in the front view of the apparatus 400. A maximum width of the continuous slit may be preferably from about 0.2 mm to about 5 mm. Alternatively, the gas output port 403 may be comprised of a plurality of openings configured to output the gas of the predetermined dryness 55. Optionally, the openings may be evenly arranged around the nozzle opening, such as illustrated in FIG. 6B. Further, whether the gas output port 403 is comprised of only a single opening or a plurality of openings, a total cross-sectional area of all openings of the gas output port 403 may be greater than a total cross-sectional area of the nozzle opening of the nozzle 402.

According to one or more embodiments of the disclosed subject matter, the nozzle 402, or a portion thereof, may be detachable from the body 401. Further, the nozzle 402 can be made of a non-conductive material or an insulating material. For example, the non-conductive material or an insulating material may be one of a resin and a plastic (or a combination or mixture thereof). As more specific examples, the nozzle 402 can be made of or include polytetrafluoroethylene (PTFE) and/or polypropylene (PP).

Figure 7:
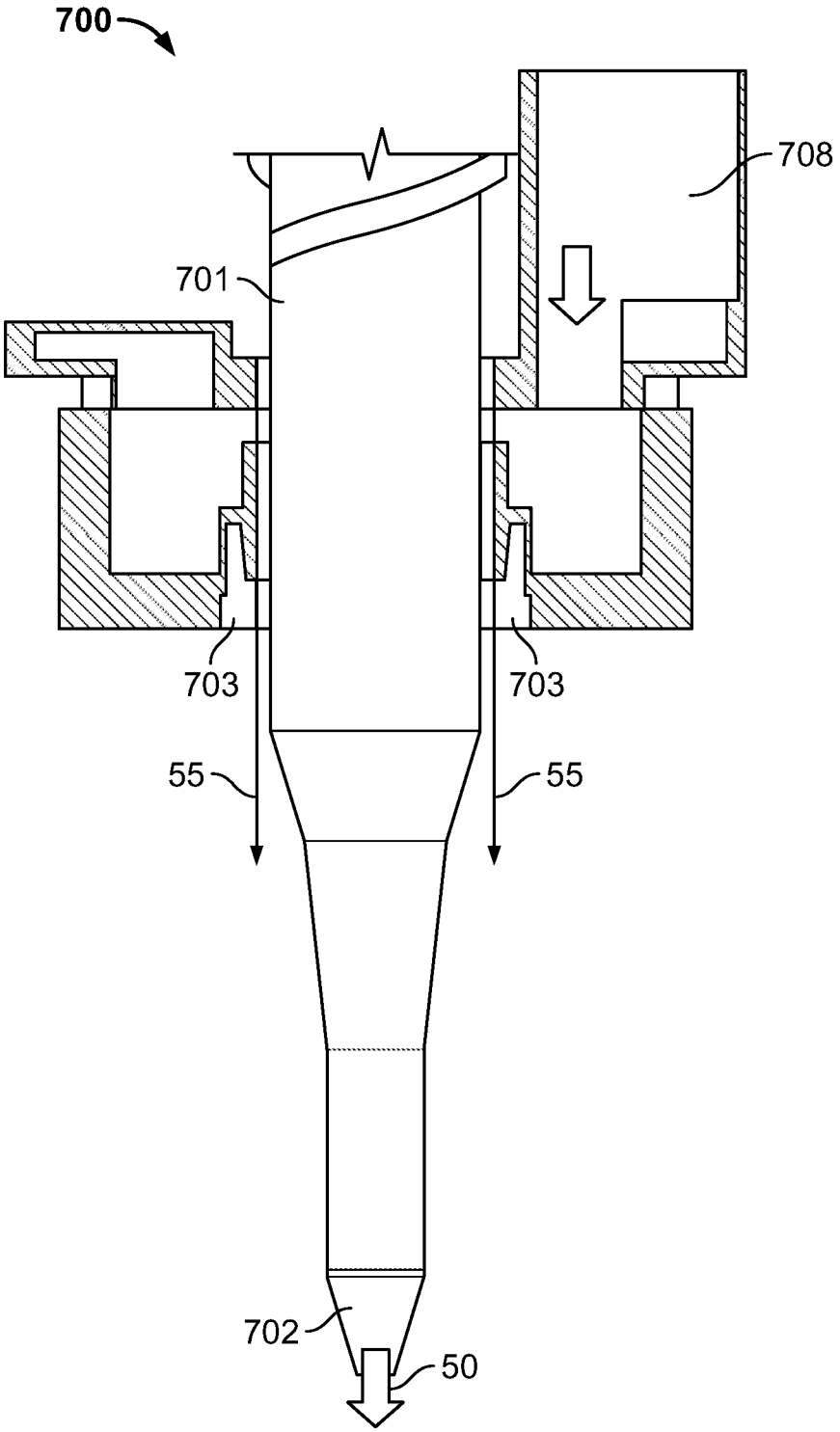
FIG. 7 is a side sectional view of an apparatus according to one or more embodiments of the disclosed subject matter.

FIG. 7 is a side sectional view of an apparatus 700 according to one or more embodiments of the disclosed subject matter. Apparatus 700 may be viewed as a variation of the apparatus 400.

The apparatus 700 can be comprised of the components expressly illustrated in FIG. 7, particularly, a body 701, a nozzle 702, a gas output port 703, and a gas supply 708. Of course, the apparatus 700 can also include other components not expressly shown, such as some or all of the components discussed above for the apparatus 100 or apparatus 400. Further, the apparatus 700 can operate the same as or substantially the same as apparatus 100 and/or apparatus 400. Like apparatus 100 above, the apparatus 700 can controllably output the charged solution 50 and gas of a predetermined dryness 55 for deposit of the charged solution 50 on the deposit surface 4 (e.g., human skin), where the gas of the predetermined dryness 55 can be provided adjacent to a nozzle tip of the nozzle 702 from where the charged solution 50 is output.

Notably for apparatus 700, the gas output port 703 can be recessed relative to a nozzle opening of the nozzle 702. For example, in one or more embodiments, the nozzle tip may project from the body 701 of the apparatus 700 more than does the gas output port 703. The gas output port 703 may overlap with the nozzle opening of the nozzle 702, for instance, concentrically aligned. That is, in the front view of the apparatus 700, a central axis of the gas output port 703 can be aligned with a central axis of the nozzle opening of the nozzle 702. Further, the apparatus 700 may have a gas output port 703 in the form of a single opening. That is, the gas output port 703 may consist of a single opening configured to output the gas of the predetermined dryness 55. For example, the single opening may define a continuous slit, either straight or curved. Optionally, the single opening may be a continuous slit that runs entirely or partially around the nozzle 702 in the front view of the apparatus 700. That is, the continuous slit may partially or fully surround the nozzle opening in the front view of the apparatus 700.

Alternatively, the gas output port 703 may be comprised of a plurality of openings configured to output the gas of the predetermined dryness 55, for instance, two openings. Optionally, the openings may be evenly arranged around the nozzle opening, for instance, on opposite sides of the nozzle 702 in the front view of the apparatus 700. Further, whether the gas output port 703 is comprised of only a single opening or a plurality of openings, a total cross-sectional area of all openings of the gas output port 703 may be greater than a total cross-sectional area of the nozzle opening of the nozzle 702.

Figure 8A:
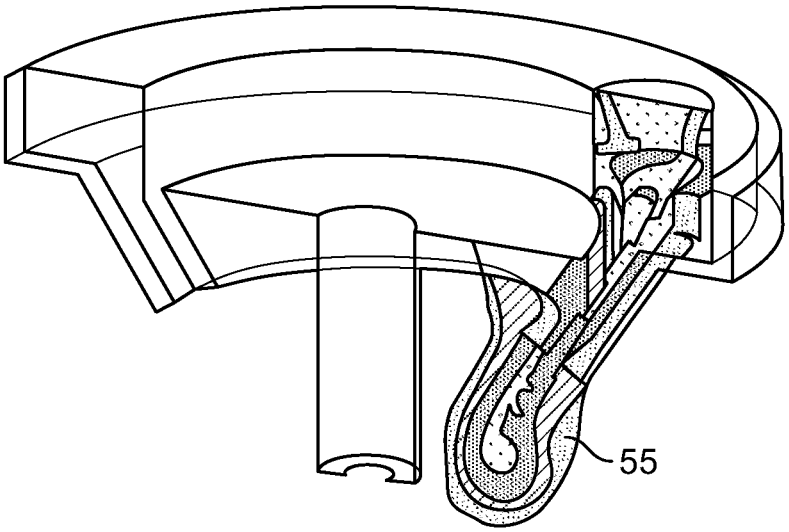
FIGS. 8A and 8B are perspective sectional views illustrating output timing according to one or more embodiments of the disclosed subject matter.
Figure 8B:
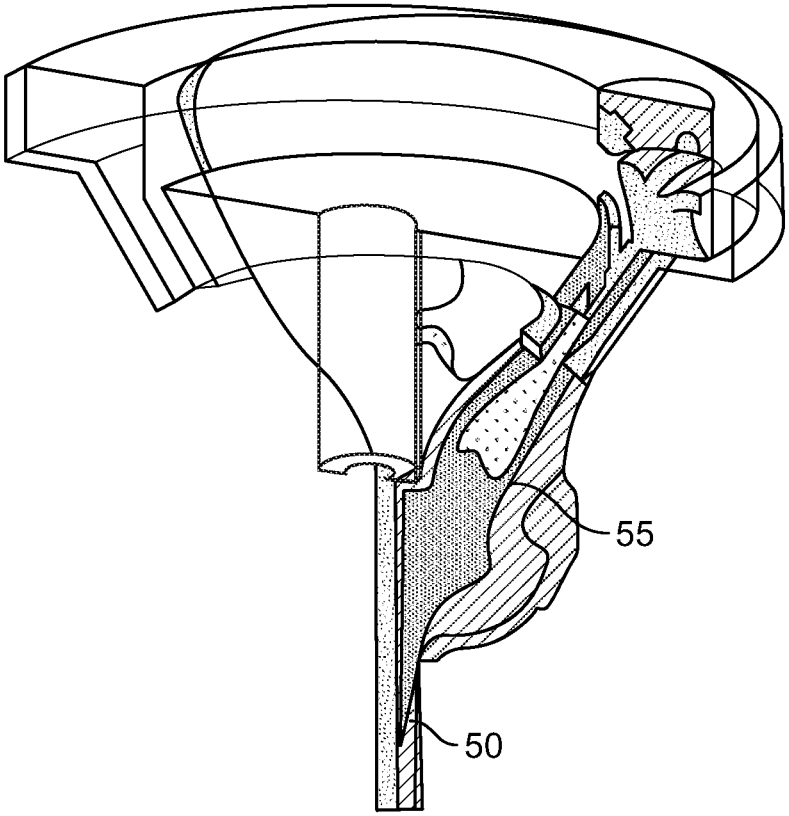
Figure 9A:
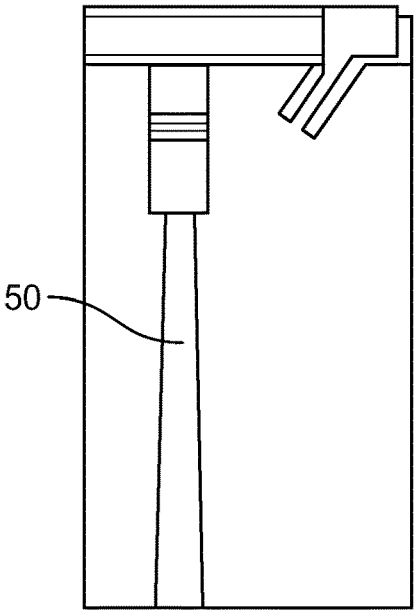
FIGS. 9A-9C are side views illustrating exemplary flow arrangements according to one or more embodiments of the disclosed subject matter.
Figure 9B:
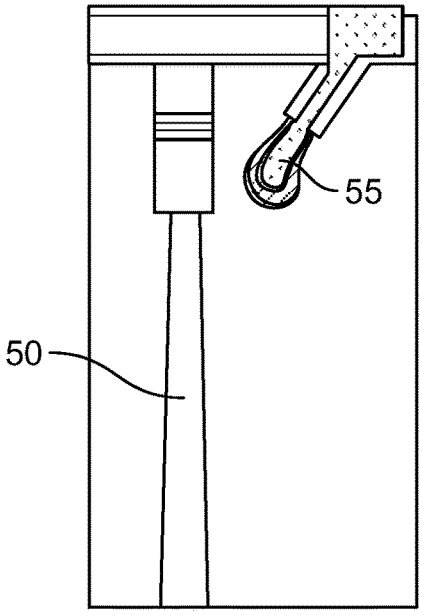
Figure 9C:
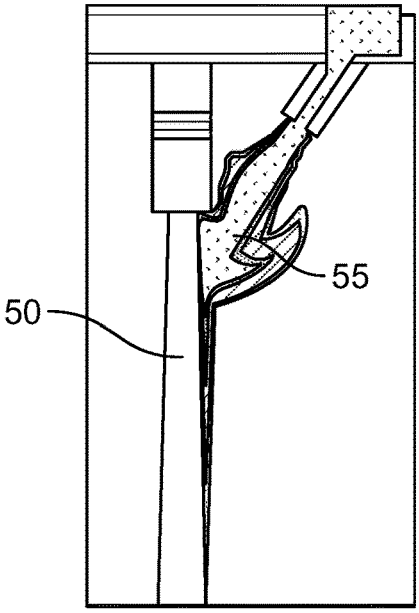

FIGS. 8A and 8B are perspective sectional views illustrating output timing according to one or more embodiments of the disclosed subject matter. Similarly, FIGS. 9A-9C are side views illustrating exemplary flow arrangements, including timings, for instance, according to one or more embodiments of the disclosed subject matter.

Optionally, in one or more embodiments, the gas of the predetermined dryness 55 can be output prior to output of the charged solution 50, such as illustrated in FIG. 8A. The charged solution 50 may then be output while the gas of the predetermined dryness 55 is still being output, such as illustrated in FIG. 8B. Alternatively, the gas of the predetermined dryness 55 may stop being output before the charged solution 50 is output. Also, in one or more embodiments, the gas of the predetermined dryness 55 may stop being output while the charged solution 50 is still being output or vice versa. Thus, during an output cycle, the gas of the predetermined dryness 55 and the charged solution 50 may be output at the same time, though with different start and/or stop times. Or, alternatively, the output of the gas of the predetermined dryness 55 and the output of the charged solution 50 may not overlap. As yet another alternative, the charged solution 50 may be output prior to output of the gas of the predetermined dryness 55, such as illustrated in FIG. 9A. Then the gas of the predetermined dryness 55 may be output while the charged solution 50 is still being output. As shown diagrammatically in FIGS. 8A, 8B, 9B, and 9C, output of the gas of the predetermined dryness 55 may result in humidity regions with differing humidity values. In these figures, the lines surrounding the gas of the predetermined dryness 55 and expanding outward therefrom can represent exemplary humidity gradients resultant from the output of the gas of the predetermined dryness 55. For example, the humidity at a space immediately surrounding the gas of the predetermined dryness 55 can be about 10% RH to about 30% RH, and the humidity at a space surrounding the previous space gas can be about 50% RH.

Figure 10:
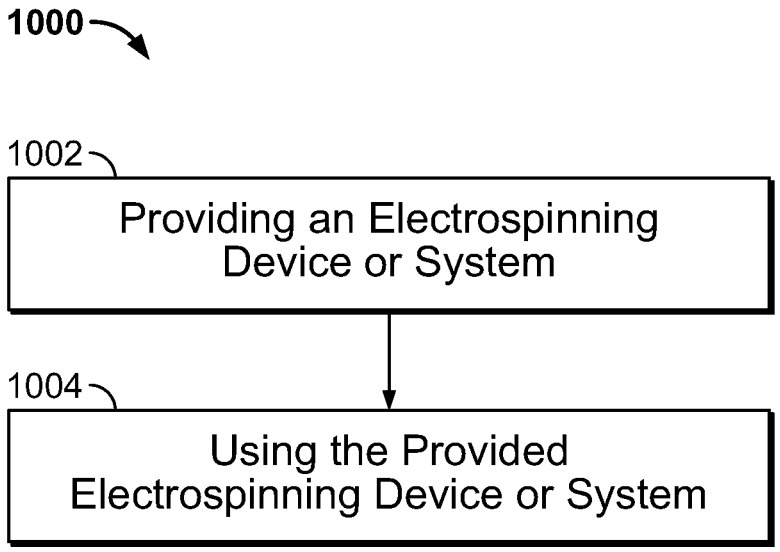
FIG. 10 is a basic flow diagram of a method according to one or more embodiments of the disclosed subject matter.

FIG. 10 is a basic flow diagram of a method 1000 according to one or more embodiments of the disclosed subject matter.

At 1002, the method 1000 can include providing an apparatus or a system according to one or more embodiments of the disclosed subject matter.

At 1004, the method 1000 can provide using the provided apparatus or system, for instance, as set forth herein. Such using can include depositing the solution on a deposit surface 4, such as a user's skin. Optionally, the electrospun solution may be deposited on top of a cosmetic already applied to the skin. Alternatively, the electrospun solution may be deposited directly on the skin. Optionally, another layer (or layers), for instance, a cosmetic layer, may be provided on the solution deposited directly on the skin. Thus, in one or more embodiments, the deposited electrospun solution may form part of a so-called multi-layer application, as either a base layer or a higher-level layer, such as a middle or an outer layer.

Prior to, during, and/or afterward, gas of a predetermined dryness, such as described herein, may be output adjacent to a nozzle of an electrospinning apparatus, charged solution output by the nozzle, a solution path between the nozzle and a deposit surface, and/or the deposit surface. Such outputting of gas of the predetermined dryness can reduce humidity of air adjacent to the nozzle of the electrospinning apparatus, the charged solution output by the nozzle, the solution path between the nozzle and the deposit surface, and/or the deposit surface. Further, optionally, once the humidity is reduced, in one or more embodiments of the disclosed subject matter, the humidity can be maintained or substantially maintained (e.g., within a predetermined range) at about the reduced humidity level by continuously or periodically outputting more gas of the predetermined dryness.

Embodiments of the disclosed subject matter may also be as set forth according to the parentheticals in the following paragraphs.

(1) An apparatus configured to controllably output a charged solution and gas of a predetermined dryness, the apparatus comprising: a nozzle configured to output the charged solution from a nozzle opening at a nozzle tip of the nozzle; and a gas output port arranged relative to the nozzle configured to output the gas of the predetermined dryness at a predetermined reference rate at a discharge opening of the gas output port, and in a predetermined direction, such that the gas of the predetermined dryness is provided adjacent to the nozzle opening, wherein the gas output port is configured to output the gas of the predetermined dryness in the predetermined direction toward a focal point at, in front of, or behind the nozzle opening.

(2) The apparatus according to (1), wherein the gas is output prior to output of the charged solution.

(3) The apparatus according to (1) or (2), wherein the charged solution and the gas of the predetermined dryness are output at a same time.

(4) The apparatus according to any one of (1) to (3), wherein the nozzle tip projects from a body of the apparatus more than does the gas output port.

(5) The apparatus according to any one of (1) to (4), wherein the gas output port is recessed relative to the nozzle tip.

(6) The apparatus according to any one of (1) to (5), wherein the apparatus is an electrospinning apparatus.

(7) The apparatus according to any one of (1) to (6), wherein the apparatus is a portable, hand-held apparatus.

(8) The apparatus according to any one of (1) to (7), wherein, in a front view of the apparatus, a central axis of the gas output port is offset from a central axis of the nozzle opening by a predetermined distance.

(9) The apparatus according to any one of (1) to (8), wherein the offset is preferably about 5 mm to about 150 mm, more preferably about 7 mm to about 20 mm.

(10) The apparatus according to any one of (1) to (9), wherein, in a front view of the apparatus the gas output port does not overlap the nozzle opening.

(11) The apparatus according to any one of (1) to (10), wherein, in a front view of the apparatus, a central axis of the gas output port is aligned with a central axis of the nozzle opening.

(12) The apparatus according to any one of (1) to (11), wherein, in a front view of the apparatus, a central axis of the gas output port is concentric with a central axis of the nozzle opening.

(13) The apparatus according to any one of (1) to (12), wherein, in a front view of the apparatus, the gas output port is a predetermined minimum distance from a central axis of the nozzle opening.

(14) The apparatus according to any one of (1) to (13), wherein the predetermined minimum distance is preferably about 5 mm to about 150 mm, more preferably about 7 mm to about 20 mm.

(15) The apparatus according to any one of (1) to (14), wherein the gas output port consists of a single gas output port opening.

(16) The apparatus according to any one of (1) to (15), wherein the single gas output port opening is in the form of a continuous slit.

(17) The apparatus according to any one of (1) to (16), wherein a maximum width of the continuous slit is from about 0.2 mm to about 5 mm.

(18) The apparatus according to any one of (1) to (17), wherein the gas output port consists of a single gas output port opening that partially or fully surrounds the nozzle opening in a front view of the apparatus.

(19) The apparatus according to any one of (1) to (18), wherein the single gas output port opening is in the form of a continuous slit.

(20) The apparatus according to any one of (1) to (19), wherein a maximum width of the continuous slit is from about 0.2 mm to about 5 mm.

(21) The apparatus according to any one of (1) to (20), wherein the gas output port includes a plurality of gas output port openings.

(22) The apparatus according to any one of (1) to (21), wherein the plurality of gas output port openings are evenly arranged around the nozzle opening.

(23) The apparatus according to any one of (1) to (22), wherein adjacent to the nozzle opening includes in front of the nozzle opening.

(24) The apparatus according to any one of (1) to (23), wherein in front of the nozzle opening includes from the tip of the nozzle to about 200 mm or less away from the nozzle tip in an axial direction of the nozzle.

(25) The apparatus according to any one of (1) to (24), wherein adjacent to the nozzle opening includes to a deposit surface for the charged solution.

(26) The apparatus according to any one of (1) to (25), wherein the deposit surface is about 30 mm away from the nozzle tip.

(27) The apparatus according to any one of (1) to (26), wherein the focal point is between the nozzle tip and about 200 mm or less away from the nozzle tip in an axial direction of the nozzle.

(28) The apparatus according to any one of (1) to (27), wherein the gas output port is configured to output the gas of the predetermined dryness in the predetermined direction toward a focal point in front of the nozzle opening that is aligned with a central axis of the nozzle opening.

(29) The apparatus according to any one of (1) to (28), wherein the focal point is between the nozzle tip and about 30 mm away from the nozzle tip in an axial direction of the nozzle.

(30) The apparatus according to any one of (1) to (29), wherein the gas output port is configured to output the gas of the predetermined dryness in the predetermined direction toward the nozzle such that the gas of the predetermined dryness is at and/or in front of the nozzle opening.

(31) The apparatus according to any one of (1) to (30), wherein the gas output port is configured to output the gas of the predetermined dryness in the predetermined direction that is non-parallel to a direction in which the charged solution is output from the nozzle opening.

(32) The apparatus according to any one of (1) to (31), wherein the gas output port is configured to output the gas of the predetermined dryness such that the gas meets the charged solution output from the nozzle opening at the nozzle tip.

(33) The apparatus according to any one of (1) to (32), wherein the gas of the predetermined dryness meets the charged solution from about at the opening at the nozzle tip to about 30 mm away from the nozzle tip in an axial direction of the nozzle.

(34) The apparatus according to any one of (1) to (33), wherein the gas of the predetermined dryness meets the charged solution at a deposit surface for the charged solution.

(35) The apparatus according to any one of (1) to (34), wherein a total cross-sectional area of all openings of the gas output port is greater than a total cross-sectional area of the nozzle opening.

(36) The apparatus according to any one of (1) to (35), wherein the gas of the predetermined dryness includes one or more of air, compressed air, $O_2$, $N_2$, Ar, He, and $CO_2$.

(37) The apparatus according to any one of (1) to (36), wherein the apparatus is configured to be operated when surrounding environmental conditions are over about 50% RH at about 25° C.

(38) The apparatus according to any one of (1) to (37), wherein the gas of the predetermined dryness reduces humidity in front of the nozzle tip.

(39) The apparatus according to any one of (1) to (38), wherein the humidity is reduced to below 50% RH.

(40) The apparatus according to any one of (1) to (39), wherein the humidity is reduced to between about 10% RH and about 30% RH.

(41) The apparatus according to any one of (1) to (40), wherein the gas of the predetermined dryness has a humidity less than a humidity of a corresponding room in which the apparatus is operated.

(42) The apparatus according to any one of (1) to (41), wherein the gas of the predetermined dryness has a humidity between about 10% RH and about 30% RH.

(43) The apparatus according to any one of (1) to (42), wherein the predetermined dryness is a predetermined RH, the apparatus being configured to output the gas of the predetermined RH to affect RH of air around the nozzle tip, the output charged solution, and/or a path or intended path between the output charged solution and a deposit surface for the charged solution.

(44) The apparatus according to any one of (1) to (43), wherein the gas of the predetermined dryness has a humidity less than a humidity of a corresponding room in which the apparatus is operated.

(45) The apparatus according to any one of (1) to (44), wherein the gas of the predetermined dryness has a humidity between about 10% RH and about 30% RH.

(46) The apparatus according to any one of (1) to (45), wherein the apparatus is configured to output the charged solution from the nozzle opening toward a deposit surface.

(47) The apparatus according to any one of (1) to (46), wherein the deposit surface is human skin.

(48) The apparatus according to any one of (1) to (47), wherein solution for output as the charged solution is output from a solution reservoir of the apparatus, the solution being a cosmetic formulation.

(49) The apparatus according to any one of (1) to (48), wherein solution for output as the charged solution is a polymer solution.

(50) The apparatus according to any one of (1) to (49), wherein the polymer solution is in the form of a water insoluble polymer having a coating formation ability.

(51) The apparatus according to any one of (1) to (50), wherein the water insoluble polymer having the coating formation ability is selected from the group: completely saponified polyvinyl alcohol, insolubilized after the formation of a coating; partially saponified polyvinyl alcohol, cross-linked after the formation of a coating when used in combination with a cross-linking agent; a oxazoline modified silicone, including a poly(N-propanoylethyleneimine)-grafted dimethylsiloxane/γ-aminopropylmethylsiloxane copolymer; polyvinylacetal diethylamino acetate; zein (main component of corn proteins); polyester; polylactic acid (PLA); an acrylic resin, including a polyacrylonitrile resin or a polymethacrylic acid resin; a polystyrene resin; a polyvinyl butyral resin; a polyethylene terephthalate resin; a polybutylene terephthalate resin; a polyurethane resin; a polyamide resin; a polyimide resin; a polyamideimide resin; and polyvinyl butyral resin.

(52) The apparatus according to any one of (1) to (51), wherein solution for output as the charged solution is a liquid agent comprising a component (a), a component (b), and a component (c) as follows: component (a) is one or more volatile substances selected from the group consisting of alcohols and ketones; component (b) is water; and component (c) is one or more polymers having a coating formation ability.

(53) The apparatus according to any one of (1) to (52), wherein the alcohols include one or more of chain aliphatic monohydric alcohols, one or more cyclic aliphatic monohydric alcohols, and/or one or more aromatic monohydric alcohols, and wherein the ketones include one or more of acetone, methyl ethyl ketone, and methyl isobutyl ketone.

(54) The apparatus according to any one of (1) to (53), wherein the alcohols consist of at least one member selected from ethanol, isopropyl alcohol, and butyl alcohol.

(55) The apparatus according to any one of (1) to (54), wherein the alcohols consist of at least one member selected from ethanol and butyl alcohol.

(56) The apparatus according to any one of (1) to (55), wherein the alcohols consist of ethanol.

(57) The apparatus according to any one of (1) to (56), wherein the gas of the predetermined dryness is output from the gas output port at the predetermined rate, which is in a range of about 0.05 m/s to about 10 m/s or about 0.15 m/s to about 1 m/s, based on a cross-sectional area of the discharge opening.

(58) The apparatus according to any one of (1) to (57), wherein the gas of the predetermined dryness is output from the gas output port at the predetermined rate toward the output charged solution, the predetermined rate being such that the gas does not propel flow of the output charged solution or modify shape of the flow of the output charged solution.

(59) The apparatus according to any one of (1) to (58), further comprising a controller configured to controllably output the charged solution and/or the gas of the predetermined dryness.

(60) The apparatus according to any one of (1) to (59), wherein the controller is configured to controllable output only the charged solution.

(61) The apparatus according to any one of (1) to (60), wherein the controller is configured to controllable output only the gas of the predetermined dryness.

(62) The apparatus according to any one of (1) to (61), further comprising a controller configured to controllably output the charged solution, the controllably outputting including one or more of changing a rate at which the charged solution is output, changing an amount of the charged solution output, a time period for which the charged solution is output, and a timing at which the charged solution is output.

(63) The apparatus according to any one of (1) to (62), further comprising a controller configured to controllably output the gas of the predetermined dryness, the controllably outputting including one or more of changing a rate at which the gas of the predetermined dryness is output, changing an amount of the gas of the predetermined dryness output, a time period for which the gas of the predetermined dryness is output, and a timing at which the gas of the predetermined dryness is output.

(64) The apparatus according to any one of (1) to (63), further comprising a controller configured to controllably output the charged solution, the controllably outputting including one or more of changing a rate at which the charged solution is output, changing an amount of the charged solution output, a time period for which the charged solution is output, and a timing at which the charged solution is output, and controllably output the gas of the predetermined dryness, the controllably outputting including one or more of changing a rate at which the gas of the predetermined dryness is output, changing an amount of the gas of the predetermined dryness output, a time period for which the gas of the predetermined dryness is output, and a timing at which the gas of the predetermined dryness is output.

(65) The apparatus according to any one of (1) to (64), further comprising a controller configured to control, for an output cycle, the gas of the predetermined dryness to be output from the gas output port followed by, at a same time, the charged solution to be output from the nozzle opening and the gas of the predetermined dryness to be output from the gas output port.

(66) The apparatus according to any one of (1) to (65), wherein the gas of the predetermined dryness is output from the gas output port for about 0.1 to about 1.0 seconds before the charged solution is output from the nozzle opening.

(67) The apparatus according to any one of (1) to (66), wherein the controller is configured to control, for the output cycle, the gas of the predetermined dryness to be stopped from being output from the gas output port prior to stopping the charged solution from being output from the nozzle opening.

(68) The apparatus according to any one of (1) to (67), wherein the controller is configured to control, during an output cycle, the gas of the predetermined dryness to be output from the gas output port one of continuously or pulsed on and off.

(69) The apparatus according to any one of (1) to (68), wherein the controller is configured to control, during an output cycle, the gas of the predetermined dryness to be output from the gas output port for a first predetermined amount of time and the charged solution to be output from the nozzle opening for a second predetermined amount of time.

(70) The apparatus according to any one of (1) to (69), wherein the first predetermined amount of time is different from the second predetermined amount of time.

(71) The apparatus according to any one of (1) to (70), wherein the first predetermined amount of time is greater than the second predetermined amount of time.

(72) The apparatus according to any one of (1) to (71), wherein the first predetermined amount of time is less than the second predetermined amount of time.

(73) The apparatus according to any one of (1) to (72), wherein the first predetermined amount of time is the same as the second predetermined amount of time.

(74) The apparatus according to any one of (1) to (73), wherein the nozzle, or a portion thereof, is detachable.

(75) The apparatus according to any one of (1) to (74), further comprising a controller configured to controllably output the charged solution, wherein the controller includes: a control switch configured to be operated by a user of the apparatus, and circuitry operatively coupled to the control switch to controllably output the charged solution from the nozzle by controlling a pump operative to cause solution to be provided to the nozzle to be output based on operation of the control switch by the user.

(76) The apparatus according to any one of (1) to (75), further comprising a controller configured to controllably output the gas of the predetermined dryness, wherein the controller includes: a control switch configured to be operated by a user of the apparatus, and a gas supply configured to provide the gas of the predetermined dryness to the gas output port based on operation of the control switch by the user.

(77) The apparatus according to any one of (1) to (76), further comprising a controller configured to controllably output the charged solution and the gas of the predetermined dryness, wherein the controller includes: a first control switch configured to be operated by a user of the apparatus, circuitry operatively coupled to the control switch to controllably output the charged solution from the nozzle by controlling a pump operative to cause solution to be provided to the nozzle to be output based on operation of the first control switch by the user, a second control switch configured to be operated by the user of the apparatus, and a gas supply configured to provide the gas of the predetermined dryness to the gas output port based on operation of the second control switch by the user.

(78) The apparatus according to any one of (1) to (77), further comprising a controller configured to controllably output the charged solution and the gas of the predetermined dryness, wherein the controller includes: a control switch configured to be operated by a user of the apparatus, circuitry operatively coupled to the control switch to controllably output the charged solution from the nozzle by controlling a pump operative to cause solution to be provided to the nozzle to be output based on operation of the control switch by the user, and a gas supply configured to provide the gas of the predetermined dryness to the gas output port based on operation of the control switch by the user.

(79) The apparatus according to any one of (1) to (78), wherein the nozzle is made of a non-conductive material or an insulating material.

(80) The apparatus according to any one of (1) to (79), wherein the non-conductive or insulating material is one of a resin and a plastic.

(81) The apparatus according to any one of (1) to (80), wherein the non-conductive or insulating material is or includes polytetrafluoroethylene (PTFE) and/or polypropylene (PP).

(82) A system configured to controllably output a charged solution and gas of a predetermined dryness, the system comprising: means for outputting the charged solution; and means for outputting the gas of the predetermined dryness at a predetermined reference rate at a discharge opening of the means for outputting the gas of the predetermined dryness, and in a predetermined direction, such that the gas of the predetermined dryness is provided adjacent to an output of the means for outputting the charged solution.

(83) A portable, hand-held electrospinning apparatus configured to provide an electrospun solution and gas of a predetermined dryness toward a deposit surface, the electrospinning apparatus comprising: a body; a nozzle provided at an extremity of the body configured to output the electrospun solution from a nozzle opening thereof toward the deposit surface; a control switch provided on the body; circuitry provided inside the body, the circuitry being operatively coupled to the control switch and controllable by manual input from a user to the control switch to controllably output the electrospun solution from the nozzle by controlling a pump operative to cause solution to be provided to the nozzle to be output as the electrospun solution; a power supply controllably coupled to the circuitry; a gas supply configured to provide the gas of the predetermined dryness; and a gas output port configured to output the gas of the predetermined dryness provided by the gas supply such that the gas of the predetermined dryness is provided adjacent to the nozzle opening, wherein the gas output port is recessed relative to the nozzle opening of the nozzle, and wherein the circuitry is configured to output the gas of the predetermined dryness prior to output of the electrospun solution.

(84) The electrospinning apparatus according to (83), wherein the circuitry is configured to output the gas of the predetermined dryness and the electrospun solution at a same time after outputting the gas of the predetermined dryness prior to the output of the electrospun solution.

(85) The electrospinning apparatus according to (83) or (84), wherein the circuitry is configured to stop output of the gas of the predetermined dryness prior to stopping output of the electrospun solution.

(86) The electrospinning apparatus according to any one of (83) to (85), wherein the circuitry is configured to stop output of the gas of the predetermined dryness prior to starting output of the electrospun solution.

(87) The electrospinning apparatus according to any one of (83) to (86), wherein the circuitry is configured to control, for an output cycle, the output of the gas of the predetermined dryness followed by output at a same time of the electrospun solution and the gas of the predetermined dryness.

(88) The electrospinning apparatus according to any one of (83) to (87), wherein the circuitry is configured to output the gas of the predetermined dryness for about 0.1 to about 1.0 seconds before the electrospun solution is output.

(89) The electrospinning apparatus according to any one of (83) to (88), wherein the circuitry is configured to control, for an output cycle, the gas of the predetermined dryness to be stopped from being output prior to stopping the electrospun solution from being output.

(90) The electrospinning apparatus according to any one of (83) to (89), wherein the circuitry is configured to control, during an output cycle, the gas of the predetermined dryness to be output for a first predetermined amount of time and the electrospun solution to be output for a second predetermined amount of time.

(91) The electrospinning apparatus according to any one of (83) to (90), wherein the first predetermined amount of time is different from the second predetermined amount of time.

(92) The electrospinning apparatus according to any one of (83) to (91), wherein the first predetermined amount of time is greater than the second predetermined amount of time.

(93) The electrospinning apparatus according to any one of (83) to (92), wherein the first predetermined amount of time is less than the second predetermined amount of time.

(94) The electrospinning apparatus according to any one of (83) to (93), wherein the first predetermined amount of time is the same as the second predetermined amount of time.

(95) The electrospinning apparatus according to any one of (83) to (94), wherein, in a front view of the electrospinning apparatus, a central axis of the gas output port is offset from a central axis of the nozzle opening by a predetermined distance.

(96) The electrospinning apparatus according to any one of (83) to (95), wherein the offset is about 12.5 mm or from about zero to about 5 inches.

(97) The electrospinning apparatus according to any one of (83) to (96), wherein, in a front view of the electrospinning apparatus, a central axis of the gas output port is aligned with a central axis of the nozzle opening.

(98) The electrospinning apparatus according to any one of (83) to (97), wherein, in a front view of the electrospinning apparatus, a central axis of the gas output port is concentric with a central axis of the nozzle opening.

(99) The electrospinning apparatus according to any one of (83) to (98), wherein, in a front view of the electrospinning apparatus, the gas output port is a predetermined minimum distance from a central axis of the nozzle opening.

(100) The electrospinning apparatus according to any one of (83) to (99), wherein the predetermined minimum distance is about 2 mm or from about zero to about 5 inches.

(101) The electrospinning apparatus according to any one of (83) to (100), wherein the gas output port consists of a single gas output port opening.

(102) The electrospinning apparatus according to any one of (83) to (101), wherein the single gas output port opening is in the form of a continuous slit.

(103) The electrospinning apparatus according to any one of (83) to (102), wherein the gas output port consists of a single gas output port opening that partially or fully surrounds the nozzle opening in a front view of the electrospinning apparatus.

(104) The electrospinning apparatus according to any one of (83) to (103), wherein the single gas output port opening is in the form of a continuous slit.

(105) The electrospinning apparatus according to any one of (83) to (104), wherein the gas output port includes a plurality of gas output port openings.

(106) The electrospinning apparatus according to any one of (83) to (105), wherein the plurality of gas output port openings are evenly arranged around the nozzle opening.

(107) The electrospinning apparatus according to any one of (83) to (106), wherein the gas output port, or a portion thereof, is detachable from the body of the electrospinning apparatus.

(108) The electrospinning apparatus according to any one of (83) to (107), wherein the gas supply, or a portion thereof, is removably coupled to the body of the electrospinning apparatus.

(109) The electrospinning apparatus according to any one of (83) to (108), wherein the gas supply, or a portion thereof, is detachable from the body of the electrospinning apparatus.

(110) The electrospinning apparatus according to any one of (83) to (109), wherein the nozzle, or a portion thereof, is removably coupled to the body of the electrospinning apparatus.

(111) The electrospinning apparatus according to any one of (83) to (110), wherein the nozzle, or a portion thereof, is detachable from the body of the electrospinning apparatus.

(112) The electrospinning apparatus according to any one of (83) to (111), wherein adjacent to the nozzle opening includes in front of the nozzle opening.

(113) The electrospinning apparatus according to any one of (83) to (112), wherein in front of the nozzle opening includes from a nozzle tip of the nozzle to about 200 mm or less away from the nozzle tip in an axial direction of the nozzle.

(114) The electrospinning apparatus according to any one of (83) to (113), wherein adjacent to the nozzle opening includes to the deposit surface, which is for deposition of the electrospun solution.

(115) The electrospinning apparatus according to any one of (83) to (114), wherein the deposit surface is about 30 mm away from a nozzle tip of the nozzle.

(116) The electrospinning apparatus according to any one of (83) to (115), wherein the gas output port is configured to output the gas of the predetermined dryness toward a focal point at, in front of, or behind the nozzle opening.

(117) The electrospinning apparatus according to any one of (83) to (116), wherein the focal point is between a nozzle tip of the nozzle and about 200 mm or less away from the nozzle tip in an axial direction of the nozzle.

(118) The electrospinning apparatus according to any one of (83) to (117), wherein the gas output port is configured to output the gas of the predetermined dryness toward a focal point in front of the nozzle opening that is aligned with a central axis of the nozzle opening.

(119) The electrospinning apparatus according to any one of (83) to (118), wherein the focal point is between a nozzle tip of the nozzle and about 30 mm away from the nozzle tip in an axial direction of the nozzle.

(120) The electrospinning apparatus according to any one of (83) to (119), wherein the gas output port is configured to output the gas of the predetermined dryness toward the nozzle such that the gas of the predetermined dryness is at and/or in front of the nozzle opening.

(121) The electrospinning apparatus according to any one of (83) to (120), wherein the gas output port is configured to output the gas of the predetermined dryness in a predetermined direction that is non-parallel to a direction in which the electrospun solution is output from the nozzle opening.

(122) The electrospinning apparatus according to any one of (83) to (121), wherein the gas output port is configured to output the gas of the predetermined dryness such that the gas meets the electrospun solution output from the nozzle opening adjacent a nozzle tip of the nozzle.

(123) The electrospinning apparatus according to any one of (83) to (122), wherein the gas of the predetermined dryness meets the electrospun solution from about at the nozzle tip to about 30 mm away from the nozzle tip in an axial direction of the nozzle.

(124) The electrospinning apparatus according to any one of (83) to (123), wherein the gas of the predetermined dryness meets the electrospun solution at the deposit surface, which is for deposition of the electrospun solution.

(125) The electrospinning apparatus according to any one of (83) to (124), wherein a total cross-sectional area of all openings of the gas output port is greater than a total cross-sectional area of the nozzle opening.

(126) The electrospinning apparatus according to any one of (83) to (125), wherein the nozzle extends from the body by a first height and the gas output port extends from the body by a second height, the first height being greater than the second height.

(127) The electrospinning apparatus according to any one of (83) to (126), wherein the gas of the predetermined dryness includes one or more of air, compressed air, $O_2$, $N_2$, Ar, He, and $CO_2$.

(128) The electrospinning apparatus according to any one of (83) to (127), wherein the deposit surface is human skin.

(129) The electrospinning apparatus according to any one of (83) to (128), wherein the electrospinning apparatus is configured to be operated when surrounding environmental conditions are over about 50% RH at about 25° C.

(130) The electrospinning apparatus according to any one of (83) to (129), wherein the gas of the predetermined dryness reduces humidity in front of a nozzle tip of the nozzle.

(131) The electrospinning apparatus according to any one of (83) to (130), wherein the humidity is reduced to below 50% RH.

(132) The electrospinning apparatus according to any one of (83) to (131), wherein the humidity is reduced to between about 10% RH and about 30% RH.

(133) The electrospinning apparatus according to any one of (83) to (132), wherein the gas of the predetermined dryness has a humidity less than a humidity of a corresponding room in which the apparatus is operated.

(134) The electrospinning apparatus according to any one of (83) to (133), wherein the gas of the predetermined dryness has a humidity between about 10% RH and about 30% RH.

(135) The electrospinning apparatus according to any one of (83) to (134), wherein the predetermined dryness is a predetermined RH, the electrospinning apparatus being configured to output the gas of the predetermined RH to affect RH of air around a nozzle tip of the nozzle, the electrospun solution, and/or a path or intended path between the electrospun solution and the deposit surface.

(136) The electrospinning apparatus according to any one of (83) to (135), wherein the electrospinning apparatus is configured to be operated outside of a humidity-controlled treatment box.

(137) The electrospinning apparatus according to any one of (83) to (136), wherein solution for output as the electrospun solution is output from a solution reservoir of the electrospinning apparatus, the solution being a cosmetic formulation.

(138) The electrospinning apparatus according to any one of (83) to (137), wherein solution for output as the electrospun solution is a polymer solution.

(139) The electrospinning apparatus according to any one of (83) to (138), wherein the polymer solution is in the form of a water insoluble polymer having a coating formation ability.

(140) The electrospinning apparatus according to any one of (83) to (139), wherein the water insoluble polymer having the coating formation ability is selected from the group: completely saponified polyvinyl alcohol, insolubilized after the formation of a coating; partially saponified polyvinyl alcohol, cross-linked after the formation of a coating when used in combination with a cross-linking agent; a oxazoline modified silicone, including a poly(N-propanoylethyleneimine)-grafted dimethylsiloxane/γ-aminopropylmethylsiloxane copolymer; polyvinylacetal diethylamino acetate; zein (main component of corn proteins); polyester; polylactic acid (PLA); an acrylic resin, including a polyacrylonitrile resin or a polymethacrylic acid resin; a polystyrene resin; a polyvinyl butyral resin; a polyethylene terephthalate resin; a polybutylene terephthalate resin; a polyurethane resin; a polyamide resin; a polyimide resin; a polyamideimide resin; and polyvinyl butyral resin.

(141) The electrospinning apparatus according to any one of (83) to (140), wherein solution for output as the charged solution is a liquid agent comprising a component (a), a component (b), and a component (c) as follows: component (a) is one or more volatile substances selected from the group consisting of alcohols and ketones; component (b) is water; and component (c) is one or more polymers having a coating formation ability.

(142) The electrospinning apparatus according to any one of (83) to (141), wherein the alcohols include one or more of chain aliphatic monohydric alcohols, one or more cyclic aliphatic monohydric alcohols, and/or one or more aromatic monohydric alcohols, and wherein the ketones include one or more of acetone, methyl ethyl ketone, and methyl isobutyl ketone.

(143) The electrospinning apparatus according to any one of (83) to (142), wherein the alcohols consist of at least one member selected from ethanol, isopropyl alcohol, and butyl alcohol.

(144) The electrospinning apparatus according to any one of (83) to (143), wherein the alcohols consist of at least one member selected from ethanol and butyl alcohol.

(145) The electrospinning apparatus according to any one of (83) to (144), wherein the alcohols consist of ethanol.

(146) The electrospinning apparatus according to any one of (83) to (145), wherein the gas of the predetermined dryness is output from the gas output port at a rate of in a range of preferably about 0.05 m/s to about 10 m/s, more preferably about 0.15 m/s to about 1 m/s.

(147) The electrospinning apparatus according to any one of (83) to (146), wherein the gas of the predetermined dryness is output from the gas output port toward the electrospun solution at a predetermined reference rate at a discharge opening of the gas output port, the predetermined rate being such that the gas does not propel flow of the electrospun solution or modify shape of the flow of the electrospun solution.

(148) The electrospinning apparatus according to any one of (83) to (147), wherein the nozzle is made of a non-conductive material or an insulating material.

(149) The electrospinning apparatus according to any one of (83) to (148), wherein the non-conductive or insulating material is one of a resin and a plastic.

(150) The electrospinning apparatus according to any one of (83) to (149), wherein the non-conductive or insulating material is or includes polytetrafluoroethylene (PTFE) and/or polypropylene (PP).

(151) The electrospinning apparatus according to any one of (83) to (150), wherein the control switch controls output of the gas of the predetermined dryness.

(152) The electrospinning apparatus according to any one of (83) to (151), further comprising a second control switch configured to controllable output the gas of the predetermined dryness based on manual input from the user.

(153) The electrospinning apparatus according to any one of (83) to (152), further comprising a humidity sensor configured to sense humidity adjacent to the electrospinning apparatus, wherein, when the humidity sensor senses humidity above a predetermined threshold, the circuitry causes an indication to be output to the user to enable output of the gas of the predetermined dryness or automatically enables output of the gas of the predetermined dryness.

(154) The electrospinning apparatus according to any one of (83) to (153), wherein the gas supply includes a regulator configured to control flow rate of the gas of the predetermined dryness, and a gas reservoir configured to hold a predetermined amount of the gas of the predetermined dryness.

(155) The electrospinning apparatus according to any one of (83) to (154), wherein the gas reservoir is one of a gas can, a compressed gas tank, and a dehumidifier system.

(156) The electrospinning apparatus according to any one of (83) to (155), wherein the circuitry is configured to controllably output the electrospun solution, the controllably outputting including one or more of changing a rate at which the electrospun solution is output, changing an amount of the electrospun solution output, a time period for which the electrospun solution is output, and a timing at which the electrospun solution is output.

(157) The electrospinning apparatus according to any one of (83) to (156), wherein the circuitry is configured to controllably output the gas of the predetermined dryness, the controllably outputting including one or more of changing a rate at which the gas of the predetermined dryness is output, changing an amount of the gas of the predetermined dryness output, a time period for which the gas of the predetermined dryness is output, and a timing at which the gas of the predetermined dryness is output.

(158) The electrospinning apparatus according to any one of (83) to (157), wherein the circuitry is configured to controllably output the electrospun solution, the controllably outputting including one or more of changing a rate at which the electrospun solution is output, changing an amount of the electrospun solution output, a time period for which the electrospun solution is output, and a timing at which the electrospun solution is output, and controllably output the gas of the predetermined dryness, the controllably outputting including one or more of changing a rate at which the gas of the predetermined dryness is output, changing an amount of the gas of the predetermined dryness output, a time period for which the gas of the predetermined dryness is output, and a timing at which the gas of the predetermined dryness is output.

(159) A method comprising: providing the apparatus according to any one of (1) to (81), the system according to (82), or the electrospinning apparatus according to any one of (83) to (158); and using the apparatus according to any one of (1) to (81), the system according to (82), or the electrospinning apparatus according to any one of (83) to (158).

(160) The method according to (159), wherein said using the apparatus or the system reduces humidity of air surrounding the nozzle, the output solution, and/or a solution path between the nozzle and the deposit surface.

(161) A method of providing, making, or using an apparatus according to any one of (1) to (81).

(162) A method of providing, making, or using a system according to (82).

(163) A method of providing, making, or using an electrospinning apparatus according to any one of (83) to (158).

Having now described embodiments of the disclosed subject matter, it should be apparent to those skilled in the art that the foregoing is merely illustrative and not limiting, having been presented by way of example only. Thus, although particular configurations have been discussed and illustrated herein, other configurations can be and are also employed. Further, numerous modifications and other embodiments (e.g., combinations, rearrangements, etc.) are enabled by the present disclosure and are contemplated as falling within the scope of the disclosed subject matter and any equivalents thereto. Features of the disclosed embodiments can be combined, rearranged, omitted, etc., within the scope of described subject matter to produce additional embodiments. Furthermore, certain features may sometimes be used to advantage without a corresponding use of other features. Accordingly, Applicant intends to embrace all such alternatives, modifications, equivalents, and variations that are within the spirit and scope of the present disclosure.

LIST OF ELEMENTS

1 user
2 hand
4 deposit surface
5 ground path
50 charged solution
55 gas of predetermined dryness
100 apparatus/system
101 body
102 nozzle
103 gas output port
104 user interface
105 high voltage electrode
106 circuitry
107 solution reservoir
108 gas supply
109 power supply
110 lower voltage power source
111 high voltage power source
112 high voltage resistor
113 controller
114 controller
115 motor
SW power switch
116 actuator
400 apparatus/system
401 body
402 nozzle
403 gas output port
406 circuitry
407 solution reservoir
408 gas supply
D1 offset distance
700 apparatus/system
701 body
702 nozzle
703 gas output port
708 gas supply
1000 method
1002 step
1004 step

The invention claimed is:

1. An apparatus configured to controllably output a charged solution and gas of a predetermined dryness, the apparatus comprising:

a nozzle configured to output the charged solution from a nozzle opening at a nozzle tip of the nozzle;

a gas output port arranged relative to the nozzle configured to output the gas of the predetermined dryness at a predetermined rate at a discharge opening of the gas output port, and in a predetermined direction, such that the gas of the predetermined dryness is provided adjacent to the nozzle opening; and a controller configured to control the gas of the predetermined dryness output from the gas output port at the predetermined rate such that the gas of the predetermined dryness does not propel flow of the output charged solution or modify shape of the flow of the output charged solution, wherein the gas output port is configured to output the gas of the predetermined dryness in the predetermined direction toward a focal point at, in front of, or behind the nozzle opening.

2. The apparatus according to claim 1, wherein the gas is output prior to output of the charged solution.

3. The apparatus according to claim 1, wherein the nozzle tip projects from a body of the apparatus more than does the gas output port.

4. The apparatus according to claim 1, wherein the apparatus is a portable, hand-held apparatus.

5. The apparatus according to claim 1, wherein, in a front view of the apparatus, a central axis of the gas output port is concentric with a central axis of the nozzle opening.

6. The apparatus according to claim 1, wherein the gas output port consists of a single gas output port opening.

7. The apparatus according to claim 6, wherein the single gas output port opening is in the form of a continuous slit.

8. The apparatus according to claim 1, wherein the gas output port consists of a single gas output port opening that partially or fully surrounds the nozzle opening in a front view of the apparatus.

9. The apparatus according to claim 1, wherein the gas output port is configured to output the gas of the predetermined dryness in the predetermined direction toward a focal point in front of the nozzle opening that is aligned with a central axis of the nozzle opening.

10. The apparatus according to claim 1, wherein the gas output port is configured to output the gas of the predetermined dryness in the predetermined direction toward the nozzle such that the gas of the predetermined dryness is at and/or in front of the nozzle opening.

11. The apparatus according to claim 1, wherein the gas output port is configured to output the gas of the predetermined dryness in the predetermined direction that is non-parallel to a direction in which the charged solution is output from the nozzle opening.

12. The apparatus according to claim 1, wherein the solution is a polymer solution in the form of a water insoluble polymer having a coating formation ability.

13. The apparatus according to claim 1, wherein solution for output as the charged solution is a liquid agent comprising a component (a), a component (b), and a component (c) as follows: component (a) is one or more volatile substances selected from the group consisting of alcohols and ketones; component (b) is water; and component (c) is one or more polymers having a coating formation ability.

14. The apparatus according to claim 1, wherein the gas of the predetermined dryness is output from the gas output port at the predetermined rate, which is in a range of about 0.05 m/s to about 10 m/s, based on a cross-sectional area of the discharge opening.

15. The apparatus according to claim 1, wherein the controller is configured to control, during an output cycle, the gas of the predetermined dryness to be output from the gas output port one of continuously or pulsed on and off.

16. The apparatus according to claim 1, wherein the controller is configured to control, during an output cycle, the gas of the predetermined dryness to be output from the gas output port for a first predetermined amount of time and the charged solution to be output from the nozzle opening for a second predetermined amount of time.

17. The apparatus according to claim 1, wherein the nozzle, or a portion thereof, is detachable.

18. The apparatus according to claim 1, wherein the gas of the predetermined dryness is output from the gas output port at the predetermined rate, which is in a range of about 0.15 m/s to about 1 m/s, based on a cross-sectional area of the discharge opening.

* * * * *